US009671091B2

(12) United States Patent
Jones

(10) Patent No.: US 9,671,091 B2
(45) Date of Patent: Jun. 6, 2017

(54) LOW PROFILE LIGHTING FIXTURE WITH MOVABLE HEAT SINK AND LIGHTING ELEMENT ASSEMBLY

(71) Applicant: Jonathan I. Jones, Highland, NY (US)

(72) Inventor: Jonathan I. Jones, Highland, NY (US)

(73) Assignee: USAI, LLC, New Windsor, NY (US)

( * ) Notice: Subject to any disclaimer, the term of this patent is extended or adjusted under 35 U.S.C. 154(b) by 0 days.

(21) Appl. No.: 15/295,527

(22) Filed: Oct. 17, 2016

(65) Prior Publication Data

US 2017/0059135 A1 Mar. 2, 2017

Related U.S. Application Data

(63) Continuation of application No. 15/256,177, filed on Sep. 2, 2016, now abandoned.

(Continued)

(51) Int. Cl.

| | |
|---|---|
| ***F21V 29/00*** | (2015.01) |
| ***F21S 8/02*** | (2006.01) |
| ***F21V 17/02*** | (2006.01) |
| ***F21V 29/74*** | (2015.01) |
| ***F21V 23/00*** | (2015.01) |
| ***F21V 17/12*** | (2006.01) |
| ***F21V 23/06*** | (2006.01) |
| ***F21V 17/18*** | (2006.01) |
| ***F21V 7/00*** | (2006.01) |
| *F21Y 115/10* | (2016.01) |

(52) U.S. Cl.

CPC ..... *F21V 17/02* (2013.01); *F21S 8/02* (2013.01); *F21V 7/00* (2013.01); *F21V 17/12* (2013.01); *F21V 17/18* (2013.01); *F21V 23/003* (2013.01); *F21V 23/06* (2013.01); *F21V 29/74* (2015.01); *F21Y 2115/10* (2016.08)

(58) Field of Classification Search

CPC ..... F21V 17/02; F21V 29/74; F21V 23/003; F21V 17/12; F21V 17/18; F21V 7/00; F21V 23/06; F21V 17/007; F21V 29/73; F21S 8/02; F21S 8/028; F21Y 2115/10

See application file for complete search history.

(56) References Cited

U.S. PATENT DOCUMENTS 5,136,493 A * 8/1992 Straus ..... F21S 8/086 362/294
7,478,931 B2 * 1/2009 Miletich ..... F21S 8/02 362/147

(Continued)

*Primary Examiner* — Peggy Neils
(74) *Attorney, Agent, or Firm* — St. Onge Steward Johnston & Reens LLC

(57) ABSTRACT

A low-profile, recessed light fixture with a housing, a lighting element enclosure with a heat sink, and a junction box containing a lighting driver. The base of the housing has an illumination aperture disposed therein. The heat sink acts as the top of the lighting element enclosure and is movable between an operation position and a service position. In the operation position, the heat sink is vertically aligned with the illumination aperture. In the service position, the heat sink is horizontally displaced from vertical alignment with the illumination aperture. When the heat sink is in the service position, the interior of the junction box is accessible through the illumination aperture, allowing the user to remove the lighting driver and other electrical components from the junction box for maintenance.

19 Claims, 28 Drawing Sheets

Related U.S. Application Data

(60) Provisional application No. 62/213,457, filed on Sep. 2, 2015.

(56) References Cited

U.S. PATENT DOCUMENTS

| | | | | |
|---|---|---|---|---|
| 9,157,609 | B2 * | 10/2015 | Littman Gatof | F21V 21/30 |
| 2010/0020551 | A1 * | 1/2010 | Kay | F21V 21/34 362/365 |
| 2010/0103686 | A1 * | 4/2010 | Fowler, Jr. | F21V 17/18 362/374 |

* cited by examiner

LOW PROFILE LIGHTING FIXTURE WITH MOVABLE HEAT SINK AND LIGHTING ELEMENT ASSEMBLY

FIELD OF THE INVENTION

The present technology relates to the field of recessed lighting fixtures. More specifically, the present technology discloses a low-profile recessed lighting fixture with convenient maintenance accessibility without detaching the fixture from the building's structure.

BACKGROUND OF THE INVENTION

Recessed lighting is very popular in residential and commercial buildings given its unobtrusive and aesthetically pleasing appearance. Recessed lighting removes from view all electric hardware and wiring, placing everything behind a wall or ceiling. However, the electrical components that power the light fixtures must be serviced from time-to-time, particularly the lighting driver that controls and powers the light source. Servicing these components can be problematic when the components are all disposed out of sight and reach.

Accordingly, there is a need in the art for a recessed light fixture that permits the user access to the electrical components, including the lighting driver, without removing the entire light fixture unit from behind the wall or ceiling tile. Since only the light source itself is typically externally accessible (for example, to change a burned out bulb), it would be preferable to allow a user access to service the electrical components through the same illumination aperture that permits light to escape from the unit's housing. It is also preferable to provide such access for maintenance using a low-profile light fixture that does not take up too much space in a wall or ceiling.

The present technology seeks to resolve the needs in the art by providing a low-profile, recessed, light fixture that allows access to service electrical components through the illumination aperture without removing the light fixture from its mounts on the building's structure.

SUMMARY OF THE INVENTION

It is therefore an object of the present technology to provide a recessed light fixture with a low profile that will allow a user to access the electrical components, including the lighting driver, for maintenance through the illumination aperture. Effectively, maintenance of the lighting driver and other electrical wires and components can be accomplished using a similar process as is commonly used to change a burned out bulb.

To accomplish its objectives, the present technology provides a low-profile light fixture with a housing, a lighting element enclosure, and a junction box. A base of the housing has an illumination aperture through which maintenance can be performed. The lighting element enclosure is preferably a substantially rectangular or square shaped box with no bottom. The top of the lighting element enclosure is preferably formed by the base of a heat sink, the base of the heat sink having a plurality of fins extending upwardly therefrom. A lighting element is disposed within the lighting element enclosure and is preferably mounted to the base of the heat sink, forming an assembly of the heat sink and the lighting element. Mounting the lighting element to the heat sink directly maximizes the effectiveness of the heat dissipation function of the heat sink.

The junction box is also preferably a substantially rectangular or square shaped box. The junction box preferably has 5 sides with an opening on one end. The opening may be covered, in some embodiments, with a removable plate or other similar cover device. A lighting driver and other electrical components are disposed within the junction box. Thus, it is the object of the present technology to allow a user access to the junction box through the illumination aperture for maintenance. It is a further object of the present technology to allow a user to remove the lighting driver from the junction box through the illumination aperture, in case, for example, it needs to be replaced. The light fixture of the present technology accomplishes these goals while maintaining a low-profile that does not overcrowd the wall or ceiling, which can be dangerous due to the heat dissipated off the heat sink.

To maintain a low profile, the top of the heat sink is no higher than the top of the junction box in some embodiments. In such embodiments, the distance between the base of the housing and the top of the lighting element enclosure, formed by the base of the heat sink, is relatively small; too small to permit the lighting driver to pass through the illumination aperture in some cases. So the objective of the present technology is to allow the heat sink to shift horizontally from an operation position, in which it is substantially vertically aligned with the illumination aperture, to a service position, in which it is horizontally displaced from vertical alignment with the illumination aperture.

Horizontally shifting the heat sink creates additional space through which a user can access the junction box and remove the lighting driver for maintenance. Specifically, the distance between the top of the junction box and the base of the housing is greater than the distance between the base of the heat sink and the base of the housing. So, when the heat sink is positioned in vertical alignment with the illumination aperture, the lighting driver cannot be removed. However, once the heat sink is shifted horizontally, the additional space between the top of the junction box and the base of the housing permits the lighting driver to pass through the illumination aperture for maintenance.

It is preferable, however, to maintain a contiguous enclosure to house the internal components of the light fixture. Thus, in preferable embodiments of the present technology, the light fixture employs a telescoping portion extending between the heat sink and the junction box to ensure no opening is created when the heat sink is shifted into the service position. The telescoping portion is preferably formed by at least four (4) walls: a vertical end wall, a horizontal top wall, and two (2) opposing vertical side walls. The end wall of the telescoping portion preferably abuts and is affixed to a side of the base of the heat sink. As such, the telescoping portion translates between operation and service positions along with the heat sink.

The horizontal top wall of the telescoping portion preferably abuts the top of the junction box, preferably the inside surface of the top of the junction box, and extends at least as far into the junction box as the heat sink is permitted to move away from the junction box. Similarly, the opposing vertical side walls of the telescoping portion preferably abut opposing side walls of the junction box, again preferably the inside surfaces, and extend at least as far into the junction box as the heat sink is permitted to move away from the junction box. Those skilled in the art will recognize alternative designs, all of which are intended to be included in the present technology's disclosure. However the telescoping portion is designed, it must be movable relative to the junction box to permit the heat sink to shift away from the junction box.

It is preferable to have the telescoping portion abut the top of the junction box both because it more effectively encloses the internal components of the light fixture and because it maximizes the height between the horizontal top wall of the telescoping portion and the base of the housing, allowing the lighting driver and other electrical components to be removed from the junction box through the illumination aperture. More specifically, when the heat sink is in the service position, the telescoping portion will be vertically aligned with the illumination aperture, at least in part. Thus it is important to accomplish the objectives of the present technology that the distance between the horizontal top wall of the telescoping portion and the base of the housing is sufficiently great to permit access to and removal of the lighting driver.

Thus the telescoping portion preferably operates as follows: when the heat sink is in the operation position, the telescoping portion is disposed, mostly if not entirely, within the junction box; when the heat sink is shifted into the service position, the telescoping portion shifts along with it, and the horizontal top wall and opposing vertical side walls are mostly exposed outside the junction box. It is preferable if a small portion remains disposed within the junction box, although it is not a necessity. In any case, in such preferable embodiments, the telescoping portion ensures that the light fixture maintains a contiguous enclosure between the junction box and the lighting element enclosure when the light fixture is in the operation position, the service position, and all positions in between.

In a particularly preferable embodiment of the present technology, the vertical end wall of the telescoping portion is substantially vertically aligned with one side of the illumination aperture when the light fixture is in the operation position. And the vertical end wall of the telescoping portion is substantially vertically aligned with a center line of the illumination aperture when the light fixture is in the service position. In some embodiments, the heat sink may shift no more than two (2) inches, or even no more than one (1) inch in some embodiments. However, the shift is still sufficient to permit access to and removal of the lighting driver through the illumination aperture.

In some embodiments, the junction box may employ a mount for the lighting driver using opposing rails to suspend the lighting driver within the junction box. In such embodiments, the mount is preferably affixed to the heat sink such that it shifts with the heat sink between the operation and service positions. Such embodiments further preferably employ a lighting driver bracket with projections to engage the opposing rails, with the lighting driver attached thereto. Thus, in such preferable embodiments, the lighting driver actually shifts along with the heat sink, bringing it closer to the illumination aperture when the heat sink is in the service position and facilitating its removal through the illumination aperture.

In some embodiments of the present technology, the light fixture employs means for biasing the heat sink toward the operation position, such as a spring or any other similar substitute means. In some embodiments, the light fixture may also or alternatively employ a locking mechanism to maintain the heat sink in the operation position, service position, or any position in between. Locking mechanisms might include a screw, hook, snap, or any similar mechanism that could prevent the heat sink from shifting horizontally. In such embodiments, the locking mechanism must be accessible by the user through the illumination aperture to ensure the technology accomplishes its objectives.

In some preferable embodiments, the lighting element enclosure may employ one or more flanges extending inwardly from one or more side walls. The flanges are preferable disposed to abut the base of the heat sink. The flanges may be used to guide the heat sink to maintain a strictly horizontal movement between operation and service positions. For example, the flanges may have a guide slot through which a pin, screw, or the like is extended and into the heat sink. Thereby, the heat sink can shift only so far as the guide slots allow and only in the direction they permit. In some preferable embodiments, the mechanism for locking the heat sink in position may employ the flanges and/or the guide slots therein. For example, a screw could be tightened through a guide slot such that the heat sink will be held in place. The screw could then be loosened to permit the heat sink to shift horizontally and tightened down again to lock the heat sink once more when the desired position is reached. Those skilled in the art will recognize alternatives to a screw locking system, and the present technology is not limited to any particularly articulated arrangement of features.

To operate preferable embodiments of the present technology, the user will gain access to the illumination aperture by removing any lighting cover, trim, reflector, and the like from outside the wall or ceiling tile. Upon gaining access to the illumination aperture, the user can reach inside and unlock the heat sink from the operation position, if necessary. Then, the user can guide the heat sink from the operation position to the service position and lock it in place in the service position, if desired. The telescoping portion will preferably extend along with the heat sink, ensuring the internal components remain fully enclosed. With the heat sink in the service position, the user will then have access to the junction box containing the lighting driver and other electronic components. If necessary, the user can remove the cover plate to access the junction box from the side. The user can then remove the lighting driver, in some embodiments from the mount, through the illumination aperture for service or replacement.

Once the maintenance is complete, the user replaces the lighting driver, replaces the cover plate on the junction box, if necessary, shifts the heat sink back to the operation position, locks it in place, if necessary, and reassembles the reflector, trim, outer cover, etc. The maintenance is fully accomplished through the illumination aperture without removing the light fixture from behind the wall or ceiling, accomplishing the objectives of the present technology.

The present technology further accomplishes its goals, in some embodiments, by providing a low-profile light fixture with a housing employing guide rails, a lighting element enclosure, and a junction box. Both the lighting element enclosure and the junction box employ pins that extend from their side walls and into the guide rails of the housing. The lighting element enclosure and junction box are accordingly limited in the length and direction of movement. A lighting element is disposed within the lighting element enclosure and accessible through an illumination aperture in the base of the housing. Preferable embodiments employ a heat sink at the top of the lighting element enclosure, wherein the base of the heat sink acts as the top or is affixed to the top of the lighting element enclosure. The heat sink operates to pull heat from the lighting element and dissipate it through fins extending upwardly from the base into an ambient environment.

To maximize the heat sink's effectiveness, preferable embodiments employ an assembly whereby the lighting element is attached directly to the base of the heat sink. In such embodiments, the heat sink, lighting element, and lighting element enclosure all operate as a single, movable unit within the housing. This assembly can be shifted between an operation position, an intermediate position, and a service position. The guide rails of the housing directs the assembly between the three positions, ensuring continued operability of the light fixture after maintenance.

The operation position is used when the light fixture is in use and the lighting element is turned on and providing light. In the operation position, the lighting element enclosure is vertically aligned with the illumination aperture. The guide rails of the housing do not permit any horizontal movement of the lighting element enclosure from the operation position. Only vertical movement is possible. In the operation position, the lighting element enclosure is in the lowest vertical position permitted by the guide rails of the housing.

From the operation position, the lighting element enclosure can be shifted vertically to the intermediate position. In the intermediate position, the lighting element enclosure is still vertically aligned with the illumination aperture. However, it is located in the highest vertical position permitted by the guide rails of the housing. From the intermediate position, the lighting element enclosure is permitted movement both in the vertical direction (back down to the operation position) or in the horizontal direction (to reach the service position).

In preferable embodiments of the technology, the junction box is adapted to shift horizontally along with the lighting element enclosure. For example, in a particularly advantageous embodiment, the lighting element enclosure employs upwardly-open hooks that will engage with the pins extending from the sides of the junction box when the lighting element enclosure is in the intermediate position. Specifically, the lighting element enclosure moves independent from the junction box in the vertical direction between the operation position and the intermediate position. As the lighting element enclosure shifts vertically from the operation position to the intermediate position, the hooks of the lighting element enclosure engage with the pins of the junction box such that, upon reaching the intermediate position, the lighting element enclosure and junction box are connected and will shift concurrently in the horizontal direction. However, since the hooks of the lighting element enclosure have an open top, if the lighting element enclosure is shifted vertically back down to the operation position, the hooks disengage from the junction box and the junction box remains independent from the lighting element enclosure's movements in the vertical direction.

Other arrangements, features, and the like can accomplish the same objectives as the hook and pin arrangement described. For example, the junction box might employ open slots in its side walls which permit the pins to shift vertically without shifting the junction box itself. The pins may be mechanically connected to arms of the lighting element enclosure. Such slots might then allow independent movement of the lighting element enclosure in the vertical direction, but force the junction box to shift along with the lighting element enclosure in the horizontal direction. Such arrangement of features would accomplish the same operability as the hook-and-pin design discussed above. Other arrangements and designs will be apparent to those skilled in the art. The technology is not limited to any particular design disclosed herein.

Once in the intermediate position, the lighting element enclosure is connected with the junction box, in preferable embodiments. As noted, the guide rails of the housing permit the lighting element enclosure to shift horizontally from the intermediate position to the service position. In the service position, the lighting element enclosure is horizontally displaced from vertical alignment with the illumination aperture. Preferably simultaneously, the junction box has been shifted horizontally such that it is now vertically aligned with the illumination aperture. Once in the service position, the guide rails of the housing permit only horizontal movement by the lighting element enclosure (and junction box, in preferable embodiments).

With the junction box vertically aligned with the illumination aperture, the user has access to the bottom of the junction box. In preferable embodiments, the bottom of the junction box has a removable plate behind which is a hole to access the inside of the junction box, which contains the lighting driver and other electrical components. The user can remove the cover plate and remove the lighting driver for service through the illumination aperture without removing the light fixture from behind the wall or ceiling, thereby accomplishing the objectives of the technology.

In preferable embodiments, the cover plate is held in place on the bottom of the junction box using some fastening mechanism, such as a screw, snap, slider, or the like. Those skilled in the art will recognize additional alternatives as well. Also preferably, the lighting driver may be mounted to the removable cover plate. In such embodiments, the user can unfasten the cover plate and remove it along with the lighting driver through the illumination aperture for service.

To operate such preferable embodiments of the present technology, the user first gains access to the illumination aperture by removing any lighting cover, trim, reflector, and the like from outside the wall or ceiling. Upon gaining access to the illumination aperture, the user can reach inside and unlock the heat sink from the operation position, if necessary. Then, the user can shift the lighting element enclosure vertically from the operation position to the intermediate position. Preferably, this shift to the intermediate position engages the junction box such that the lighting element enclosure and junction box will shift concurrently in the horizontal direction. From the intermediate position, the user can then shift the lighting element enclosure horizontally into the service position. Once in the service position, the lighting element enclosure is horizontally displaced from vertical alignment with the illumination aperture and the junction box is preferably now vertically aligned with the illumination aperture. At this point, the user may lock the lighting element enclosure into place, in some embodiments, and access the bottom of the junction box. The user removes the removable cover plate using the fastening mechanism, if present, to reveal an opening into the junction box. The user then has access to and can remove the lighting driver and other electrical components from the junction box through the illumination aperture for service.

While it is preferable that the junction box and lighting element enclosure shift concurrently in the horizontal direction, it is not a requirement of the present technology. For example, the user might manually first shift the lighting element enclosure and then independently shift the junction box. Such an embodiment would operate as follows: the user accesses the lighting element enclosure through the illumination aperture; the user shifts the lighting element enclosure vertically from the operation position to the intermediate position; the user shifts the lighting element enclosure from the intermediate position to the service position; the user then independently shifts the junction box to the service position such that the junction box is vertically aligned with the illumination aperture; finally, the user accesses the junction box by removing the cover plate and removing the lighting driver and/or other electronic components through the illumination aperture for service.

Those skilled in the art will appreciate the many alterations possible to the presently described technology. The present technology is not limited to the embodiments and arrangements described above. Other objects of the present technology and its particular features and advantages will become more apparent from consideration of the following drawings and detailed description of the technology.

DETAILED DESCRIPTION OF THE INVENTION

Figure 1:
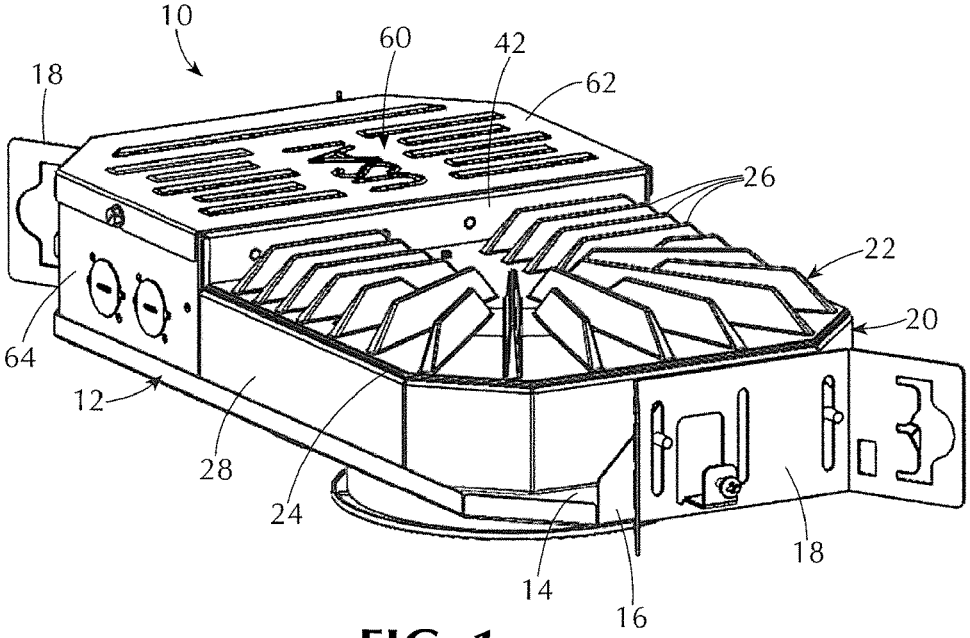
FIG. 1 is a perspective view from the top of a light fixture constructed in accordance with exemplary embodiments of the present technology and showing the light fixture in the operation position.

The following detailed description illustrates the technology by way of example, not by way of limitation of the principles of the invention. This description will enable one skilled in the art to make and use the technology, and describes several embodiments, adaptations, variations, alternatives, and uses of the invention, including what is presently believed to be the best mode of carrying out the invention. One skilled in the art will recognize alternative variations and arrangements, and the present technology is not limited to those embodiments described hereafter. The low profile light fixture disclosed herein is described as if oriented in a manner to be installed in a horizontal ceiling, using terms such as vertical, horizontal, upper, lower, etc. However, it is to be understood that the light fixture can be placed and used in other orientations, such as vertical walls or other non-horizontal surfaces.

The low profile lighting fixture disclosed herein is particularly suitable as a recessed lighting fixture. The lighting fixture includes a housing operable to mount the lighting fixture to a structure such as ceiling or wall structural supports, a lighting element operable to produce light such as Light-Emitting Diodes (LEDs), an illumination aperture through which light passes from the illumination element to outside of the lighting fixture, a heat sink operable to dissipate heat generated by the lighting element to an ambient environment, a junction box for containing a lighting driver and the electrical connections delivering power to the lighting driver. The lighting element is preferably mounted to the heat sink forming an assembly of the heat sink and lighting element.

To minimize the profile (height) and overall size of the lighting fixture while maintaining a high level of serviceability after installation, the assembly of the heat sink and lighting element can move relative to the housing (and junction box) from an operation position disposed over the illumination aperture to a service position substantially displaced from the operation position to allow access to and removal/replacement of the lighting driver through the illumination aperture after the lighting fixture has been installed. Movement of the assembly from and to the operation and service positions can be affected by hand through the illumination aperture after the lighting fixture has been installed. Preferably, the assembly of the heat sink and lighting element can be selectively locked in the operation position, or is biased in the operation position.

When the assembly of the heat sink and lighting element are in the operation position, the lighting driver cannot be removed from or placed in the junction box through the illumination aperture. In contrast, when the assembly is in the service position, the lighting driver can be removed from and placed in the junction box through the illumination aperture.

The movement of the assembly of the heat sink and lighting element from the operation to the service position preferably increases a height of the housing and/or junction box in the area of (above) the illumination aperture and/or moves the lighting driver from an operation position to a service position disposed over or substantially closer to the illumination aperture to allow removal and replacement of the lighting driver.

The movement of the assembly of the heat sink and lighting element relative to the housing can be a linear horizontal movement or can be another movement such as linear vertical, rotational (in a vertical or horizontal plane or another plane, or helical/twisting), or can be a combination of such movements or other movements.

In one embodiment, the lighting fixture includes a housing having a substantially planar base with an opening for transmission of light out of the housing. An aperture plate, with an aperture forming structure typically depending downwardly from the aperture plate, can be attached to the base, such as to a bottom surface thereof. The aperture plate and aperture forming structure form an illumination aperture having an aperture plane substantially parallel with the base of the housing and having a center axis perpendicular to the aperture plane and passing through a center of the illumination aperture.

The base preferably includes end walls on opposing sides of the housing for attachment of the housing to support structures, such as ceiling or wall structural supports. As is known, attachment brackets such as butterfly brackets can be attached to the end walls to facilitate attachment of the light fixture to a support structure.

On one side, the housing includes a junction box portion for containing a lighting driver and the electrical connections delivering power to the lighting driver. The junction box is preferably integrally formed with or attached to the base. On an opposing side, and generally adjoining the junction box, the housing includes a light enclosure portion for enclosing a lighting element, such as one or more Light-Emitting Diodes (LEDs), which may, for example, be mounted on a PCB or other substrate.

The fixture includes a heat sink having a base and fins to dissipate heat generated by the lighting element into the surrounding environment (air). A bottom surface of the base of the heat sink forms a ceiling of the light enclosure and is disposed opposite the illumination aperture. The lighting element is mounted to the bottom surface of the base of the heat sink.

The heat sink is slidably mounted to the housing and is operable to slide (translate) parallel to the base of the housing (i.e., horizontally in a typical horizontal ceiling installation) from an operation position to a service position, for example by a movement distance about 1 to 2 inches. The lighting element moves with the heat sink. In the operation position (FIGS. 1 and 10), the lighting element is centered over the illumination aperture such that an optical axis of the lighting element is substantially aligned with the center axis passing through the center of the illumination aperture. In the service position (FIGS. 2 and 11), the lighting element is displaced laterally (perpendicular to the center and optical axes) by a distance equal to the movement distance of the heat sink. To allow for unhindered movement of the heat sink when the lighting fixture is installed and mounted to a structure, the end wall of the base adjacent the lighting enclosure is spaced from an adjacent end of the heat sink in the operation position by a distance at least equal to the movement distance of the heat sink.

Preferably, a top wall of the junction box portion of the housing is substantially planar and is substantially co-planar with the top of the heat sink (or the tops of the fins of the heat sink). The bottom surface of the base of the heat sink (forming a ceiling of the light enclosure) is lower than the top wall of the junction box such that a height of the light enclosure (as measured from a plane of the base of the housing to the bottom of the base of the heat sink) is less than a height of the junction box (as measured from the plane of the base of the housing to the top wall of the junction box portion.

Vertical side wall portions of the junction box extend upwardly on opposite sides of the housing from the base to the top wall of the junction box and join with vertical side wall portions of the light enclosure which extend from the base to the heat sink. Due to the greater height of the junction box, the side walls of the junction box have a height greater than the side walls of the light enclosure.

A telescoping portion of the light enclosure is attached to the heat sink to maintain a contiguous enclosure between the junction box and light enclosure portions in the operation and service positions, and in all positions therebetween. The telescoping portion extends into an interior of the junction box when the heat sink is in the operation position and at least partially retracts as the heat sink is moved to the services portion. The telescoping portion has four sides including a vertical end wall abutting an end of the base of the heat sink adjacent the junction box. The end wall spans between the side walls of the light enclosure and extends upwardly from the top of the side walls to a height slightly below the top wall of the junction box. A horizontal top wall of the telescoping portion extends from the end wall in a direction toward the junction box and is preferably aligned to closely abut a lower (i.e., interior) surface of the top wall of the junction box. A pair of opposed, vertical side walls of the telescoping portion are connected to the end and top walls and are aligned to closely abut interior surfaces of corresponding side walls of the junction box.

In the operation position, the end wall of the telescoping portion is substantially aligned with the junction between the side walls of the junction box and light enclosure portions, and the top wall and side walls of the telescoping portion are substantially or entirely within the interior of the junction box. The lateral length of the top and side walls of the telescoping portion (as measured in a direction of movement of the heat sink) is at least equal to the movement distance of the heat sink. Therefore, the telescoping portion maintains a contiguous enclosure between the junction box and light enclosure in both the operation and service positions, and in all positions therebetween.

Preferably each of the side walls of the light enclosure includes a horizontal, inwardly-extending flange having a guide slot to slidingly guide movement of the heat sink relative to the housing. Screws, rivets or other fasteners can be directed through the guide slots into the base of the heat sink to slidingly connect the heat sink to the housing. A locking screw accessible thought the illumination aperture can also be provided in one or both of the guide slots or in a different slot or hole in the flanges to selectively fix the heat sink in the operation position.

To remove or replace the lighting driver when the light fixture is installed, the heat sink can be moved into the service position by removing or loosening the locking screw (if present) and sliding the heat sink from the operation position into the service position. By this movement, the end wall of the telescoping portion is moved closer to a center line of the illumination aperture thereby providing greater clearance to remove and replace the lighting driver. For example, in the operation position, the end wall of the telescoping portion can be substantially aligned with an edge of the illumination aperture (as viewed from below) and in the service position, that end wall can be at or substantially adjacent a center of the illumination aperture (as viewed from below). This has the effect of extending the length of the junction box, which has a height greater than that of the light enclosure, which assists in the removal and replacement of the lighting driver and other service of the light fixture. For example, in the service position, the lighting driver can be tilted downward such that it can pass through the illumination aperture. When the lighting driver has been replaced, the heat sink can be moved back into the operation position and secured in place by the locking screw.

Optionally, a lighting driver mount having opposed mounting guide rails can be fixed to the heat sink and disposed adjacent a top of the junction box for slidably mounting (suspending) the lighting driver having attached thereto a mounting bracket having projections which engage the mounting guides. The lighting driver mount can be slidingly supported by the top wall of the junction box.

Further, modular electrical connectors for controlling and/or delivering power to the lighting element can be removably fixed to the heat sink below the top wall of the telescoping portion such that the connectors move with the heat sink and are easily accessible in the service position.

In a second embodiment, the assembly of the heat sink and lighting element move from the operation position to the service position in a two-step movement including a first movement which is vertically upward then a second movement which is horizontal. Preferably, the assembly of the heat sink and lighting element includes upwardly-open hooks or other means which engage complementary pins or other structure of the junction box such that during the second movement the assembly pulls the junction box from the operation position (substantially displaced from the illumination aperture) to or toward the service position (substantially over or closer to the illumination aperture).

In the operation position, the assembly of the heat sink and lighting element are preferably confined in horizontal directions but can be moved vertically to a position in which the assembly can move horizontally into the service position. Thus, to move the assembly of the heat sink and lighting element from the operation position to the service position, the assembly is first lifted vertically and then horizontal. The housing preferably includes guide rails for guiding and confining movement of the assembly of the heat sink and lighting element and the junction box.

The lighting driver is affixed to a mounting plate which is removably mounted to a bottom of the junction box with the lighting driver extending through the hole and disposed within the junction box. In the service position, the assembly of the lighting driver and mounting plate can be removed from the lighting fixture by disconnecting the mounting plate from the junction box and removing the assembly through the illumination aperture.

Figure 2:
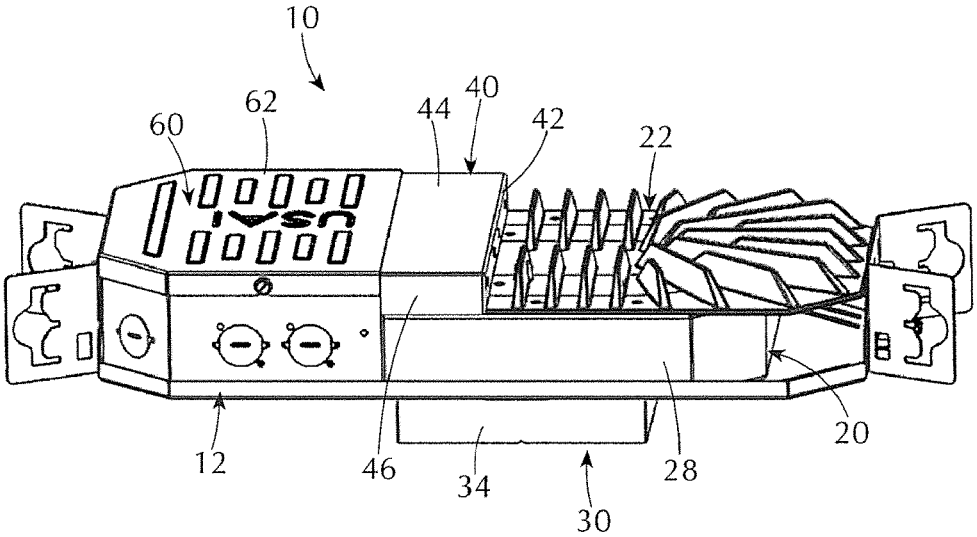
FIG. 2 is a perspective view from the top of the light fixture constructed in accordance with exemplary embodiments of the present technology displayed in FIG. 1 and showing the light fixture in the service position.

Referring now to FIGS. 1 and 2, a preferable embodiment of the light fixture 10 according to the present technology employs a housing 12 with a base 14 and opposing end walls 16. In some preferable embodiments, unit mounting brackets 18 may be attached to the end walls 16 of the housing 12 so as to affix the light fixture 10 to the structure of a house or building. The unit mounting brackets 18 may preferably employ butterfly brackets or other types of brackets known to those of ordinary skill in the industry.

In addition to the housing 12, preferable embodiments of the light fixture 10 also employ a lighting element enclosure 20 and a junction box 60 disposed laterally (horizontally) adjacent the light element enclosure 20. A heat sink 22 preferably forms the top of the lighting element enclosure 20. More specifically, the lower surface of a base 24 of the heat sink forms the top of the lighting element enclosure 20. Alternatively, the base 24 of the heat sink 22 may be affixed to the top of the lighting element enclosure 20. The heat sink 22 employs a base 24 and a plurality of fins 26 extending upwardly therefrom. The fins 26 of the heat sink operate to transfer heat from the light fixture 10 into the surrounding ambient environment.

In preferable embodiments wherein the base 24 of the heat sink 22 forms the top of the lighting element enclosure 20, the lighting element 32 is affixed directly to the base 24 of the heat sink 22. In such embodiments, the heat generated by the lighting element 32 is more effectively dissipated by the heat sink 22. In some embodiments, the lighting element 32 may instead be affixed to a top of the lighting element enclosure 20 and the heat sink 22 may be affixed to the opposite side of the top of the lighting element enclosure 20. In either arrangement, it is preferable that the lighting element 32, heat sink 22, and top of the lighting element enclosure (if separate) all shift simultaneously when the light fixture 10 is shifted from the operation position to the service position.

Preferable embodiments of the light fixture further employ a telescoping portion 40 connected to the heat sink 26 comprising a vertical end wall 42, a horizontal top wall 44, and two vertical side walls 46 extending laterally. In the preferable embodiment of the light fixture depicted in FIG. 1, the vertical end wall 42 of the telescoping portion 40 extends vertically from the base 24 of the heat sink 26 to a top 62 of the junction box 60. The distance from the top 62 of the junction box 60 to the base 14 of the housing 12 is larger than the distance from the base 24 of the heat sink 22 to the base 14 of the housing 12. The vertical end wall 42 of the telescoping portion 40 spans the gap between the base 24 of the heat sink 26 to the top 62 of the junction box 60 to maintain a contiguous enclosure for the internal parts of the light fixture 10.

When the light fixture 10 is in the operation position as depicted in FIG. 1, only the vertical end wall 42 of the telescoping portion 40 is visible. The horizontal top wall 44 and the vertical side walls 46 of the telescoping portion 40 are preferably disposed substantially or entirely within the junction box 60. Preferably, the horizontal top wall 44 and the vertical side walls 46 of the telescoping portion 40 abut the inner surfaces of the top 62 wall and laterally-extending side walls 64 of the junction box 60, respectively. However, other arrangement are possible and will be recognized by those skilled in the art. However arranged, the telescoping portion 40 should be movable relative to the junction box 60.

When the light fixture 10 is in the service position as depicted in FIG. 2, the heat sink 22 has shifted laterally horizontally relative to the housing 12, lighting element enclosure 20, and junction box 60. The telescoping portion 40 preferably shifts with the heat sink 22 as depicted. Accordingly, the horizontal top wall 44 and vertical side walls 46 of the telescoping portion 40 translate horizontally to span the gap between the heat sink 22 and junction box 60, again maintaining a contiguous enclosure for the internal parts of the light fixture 10.

Specifically, as depicted, the horizontal top wall 44 of the telescoping portion 40 forms a contiguous top surface between the top 62 of the junction box 60 and the vertical end wall 42 of the telescoping portion 40, which is preferably affixed to the base 24 of the heat sink 22. Similarly, the vertical side walls 46 of the telescoping portion 40 form a contiguous side surface between the side walls 64 of the junction box 60, the side walls 28 of the lighting element enclosure 20, and the vertical end wall 42 of the telescoping portion 40. Thus, the telescoping portion maintains a contiguous enclosure for the internal components of the light fixture 10 whether it is in the operation position, service position, or any position in between.

Figure 3:
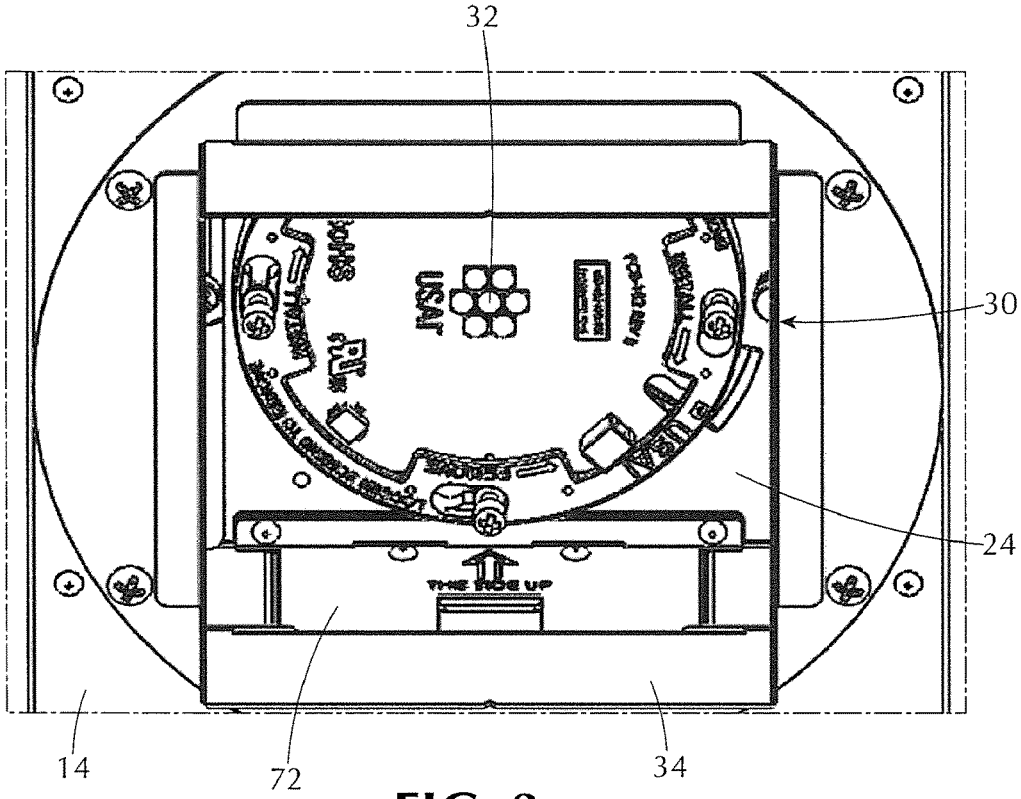
FIG. 3 is a bottom view of the light fixture constructed in accordance with exemplary embodiments of the present technology displayed in FIG. 1 and showing the light fixture in the operation position.

In FIG. 3 the light fixture 10 is shown in the operation position, with a view from below through the illumination aperture 30 and into the lighting element enclosure 20. The illumination aperture 30 is disposed in the base 14 of the housing 12. The illumination aperture 30 permits light from the lighting element 32 to escape the light fixture 10 when in operation. In the operation position, the lighting element 32 is vertically aligned with the illumination aperture 30.

Figure 4:
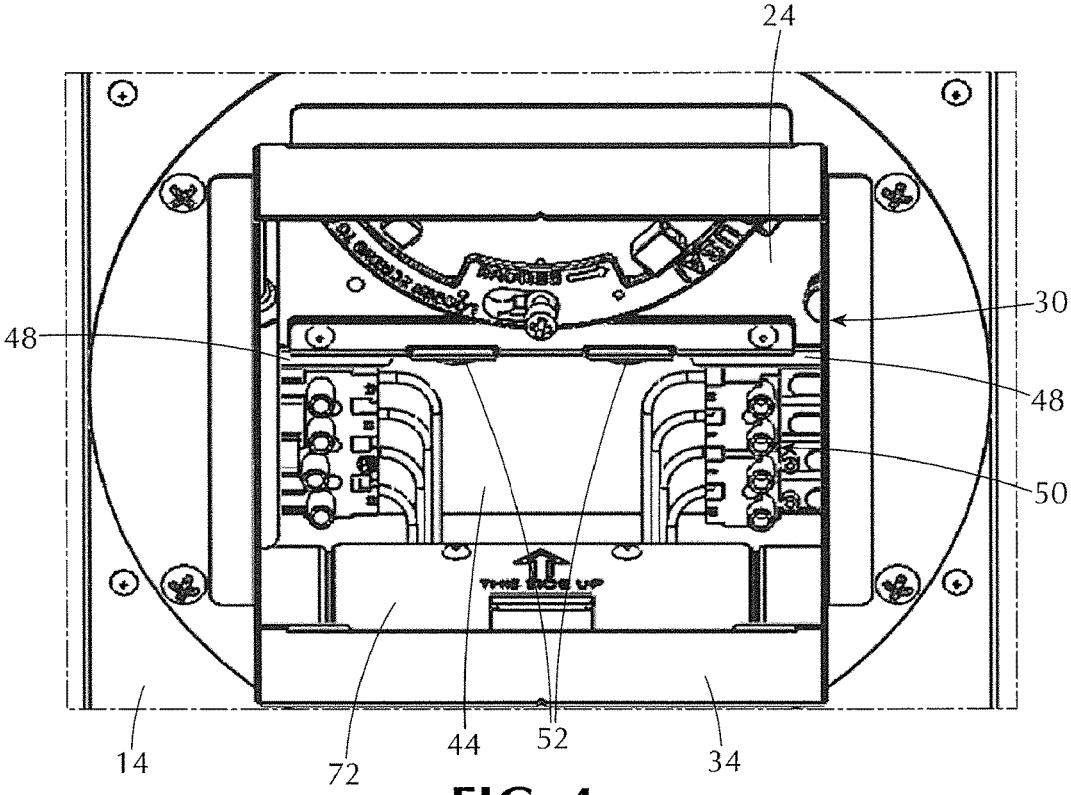
FIG. 4 is a bottom view of the light fixture constructed in accordance with exemplary embodiments of the present technology displayed in FIG. 1 and showing the light fixture in the service position.

In FIG. 4, the light fixture 10 is shown in the service position from below, again with a view up through the illumination aperture 30 and into the lighting element enclosure 20. As depicted, when the light fixture 10 is in the service position, the lighting element 32 and heat sink 22 have shifted horizontally respective to the illumination aperture 30 such that they are horizontally displaced from vertical alignment with the illumination aperture 30. The shift of the heat sink 22 allows access to the junction box 60 and the lighting driver 70 and other electrical components disposed therein.

In some embodiments, a cover plate 72 may restrict access to the junction box 60. In some such embodiments, the cover plate 72 can be removed only once the heat sink 22 has been shifted into the service position. Other embodiments employ a cover plate 72 that can be removed whether the heat sink 22 is in the service position or the operation position, although the lighting driver 70 may only be removable in the service position. In some embodiments, the cover plate 72 may employ a locking mechanism to keep it in place during operation of the light fixture 10 and/or during shifting between the operation position and the service position. Such embodiments may employ a screw, hook, snap, slider, biased projection, or other comparable locking mechanism, as will be ascertainable to those skilled in the art.

One particularly preferable embodiment of the cover plate 72 employs a slider that can be engaged or disengaged through the illumination aperture 30. The slider has projections that move to engage and disengage with comparable projections affixed to the junction box 60, allowing the user to remove the cover plate 72 to access the interior of the junction box 60. Whatever arrangement is used, the locking mechanism for the cover plate 72 should be accessible by the user through the illumination aperture 30.

Figure 5:
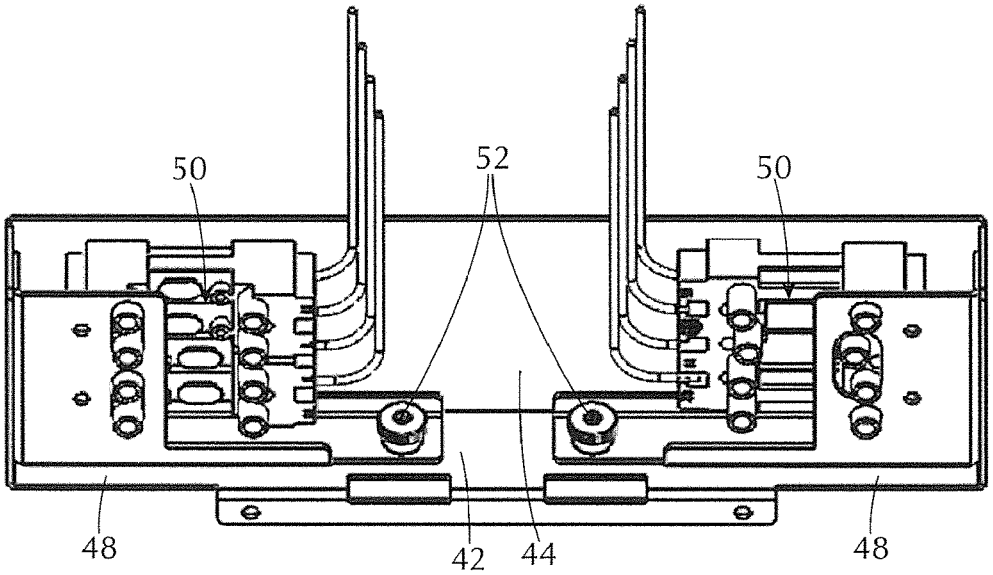
FIG. 5 is close-up, internal view of the light fixture constructed in accordance with exemplary embodiments of the present technology displayed in FIG. 1 and showing the removable brackets for mounting the electrical connectors.

FIG. 5 depicts a close-up view of particular embodiments of the present technology that employ removable electrical connector brackets 48. The electrical connectors 50 are affixed to the brackets 48. The brackets 48 are preferably removably affixed to the end wall 42 of the telescoping portion 40. As such, the brackets 48 and the affixed electrical connectors 50 shift along with the heat sink 22 when the heat sink 22 is moved between the operation position and the service position. The brackets 48 are preferably removable using thumb nuts 52 accessible by the user through the illumination aperture, as depicted. Other comparable engagement methods are available and will be recognized by those of skill in the art, and the present technology is not intended to be limited to this particular embodiment.

When the light fixture 10 is in the operation position, the brackets 48, electrical connectors 50, and wiring are preferably substantially disposed within the junction box 60. To remove the brackets 48, the user shifts the heat sink into the service position, exposing the brackets 48 outside the junction box 60, and then accesses the engagement mechanism, such as the thumb nuts 52 depicted in FIG. 5, to disengage the brackets 48. The brackets 48 can then be removed from the light fixture 10 through the illumination aperture 30 along with the electrical connectors 50 affixed thereto. The user can then service and/or replace the electrical connectors 50 and wires before reengaging the brackets 48 with the heat sink 22.

Figure 6:
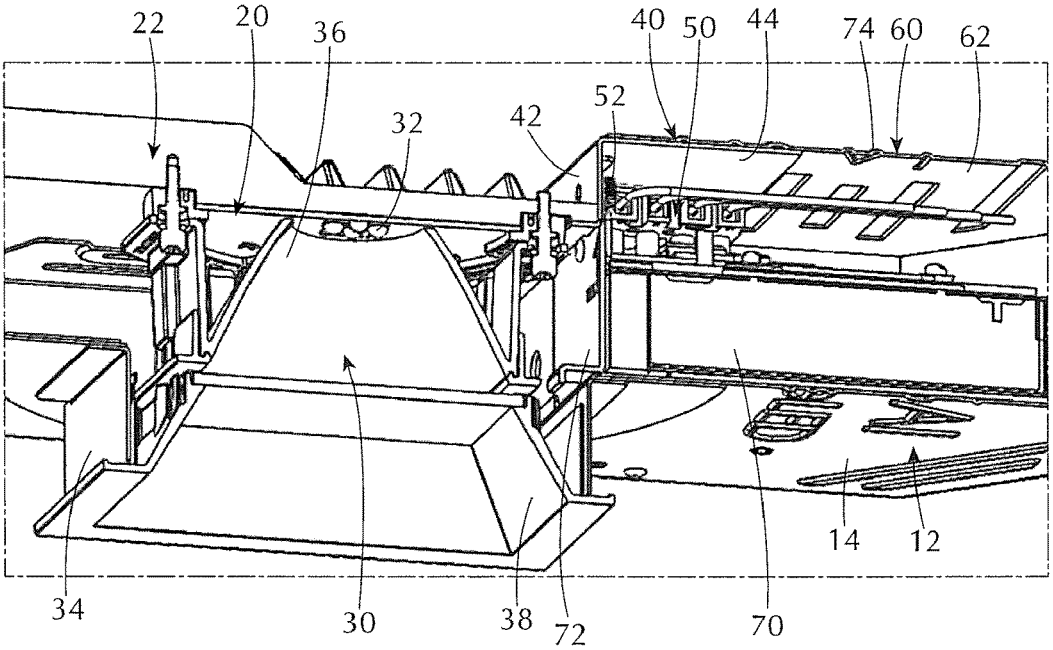
FIG. 6 is a cross-section elevation view of the light fixture constructed in accordance with exemplary embodiments of the present technology displayed in FIG. 1 and showing the light fixture in the operation position.

Referring next to FIG. 6, the light fixture 10 is depicted in the operation position according to preferable embodiments of the technology. As shown, the housing 12 contains the lighting element enclosure 20 and the junction box 60. The base 14 of the housing 12 includes the illumination aperture 30. Because the light fixture 10 is depicted in the operation position, the lighting element enclosure 20 is vertically aligned with the illumination aperture 30 and the lighting element 32 is preferably vertically aligned with a center of the illumination aperture 30. As shown, the heat sink 22 spans the width of the illumination aperture 30 in a lateral (horizontal) direction. Also depicted are vertical aperture flanges 34 extending down from the illumination aperture 30 as well as a reflector 36 and trim 38. The reflector 36 and trim 38 are removable from outside the light fixture 10 so the user can access the interior of the housing 12 through the illumination aperture 30.

The heat sink 22 forms the top of the lighting element enclosure 20. The lighting element 32 is affixed to the lower surface of the base 24 of the heat sink 22. The vertical end wall 42 of the telescoping portion 40 abuts and is affixed to the heat sink 22 such that the telescoping portion 40 moves with the heat sink 22 as it shifts between the operation position and the service position. As depicted, the horizontal top wall 44 of the telescoping portion 40 movably abuts the interior surface of the top 62 of the junction box 60. Though not shown, the vertical side walls 46 of the telescoping portion 40 similarly movably abut the interior surface of the side walls 64 of the junction box 60. Each of the horizontal top wall 44 and the two vertical side walls 46 of the telescoping portion 40 are almost entirely contained within the junction box 60 when the light fixture 10 is in the operation position, as is preferable.

The lighting driver 70 and the electrical components 50 are preferably disposed within the junction box 60 when the light fixture 10 is in the operation position, as depicted in FIG. 6. In some embodiments, access to the junction box 60 is restricted with a removable cover plate 72. As noted, the cover plate 72 may employ a locking mechanism, such as a screw, hook, snap, slider, etc. to hold it in place. In some embodiments, the lighting driver 70 may be contained in a driver drawer 74 removable along with the lighting driver 70 from the junction box 60. In such embodiments, the cover plate 72 may be formed by an end wall of the driver drawer 74, as depicted in FIG. 6.

Figure 7:
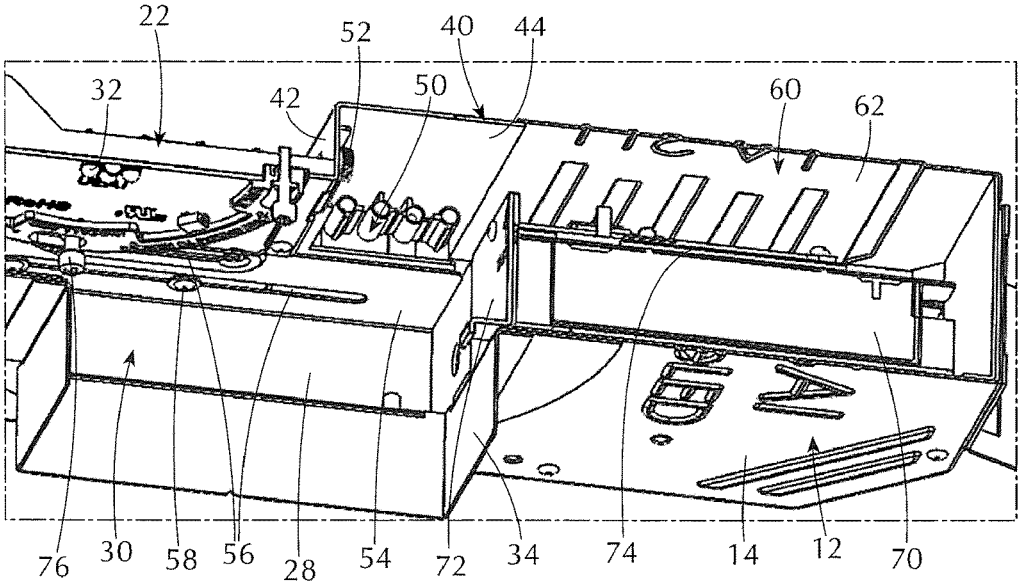
FIG. 7 is a cross-section elevation view of the light fixture constructed in accordance with exemplary embodiments of the present technology displayed in FIG. 1 and showing the light fixture in the service position.

Referring next to FIG. 7, the light fixture 10 is depicted in the service position according to preferable embodiments of the technology. The reflector 36 and trim 38 have been removed to allow the assembly of the heat sink 22 and lighting element 32 to move and to provide the user access to the interior of the housing 12 through the illumination aperture 30. The heat sink 22 has been shifted horizontally such that it is laterally displaced from vertical alignment with the illumination aperture 30, placing the light fixture 10 in the service position, and the telescoping portion 40, the connector brackets 48 and thumb nuts 52 connected thereto have shifted along with the heat sink 22.

As depicted, the telescoping portion 40 extends to maintain a contiguous enclosure when the light fixture 10 is in the service position. More specifically, the horizontal top wall 44 of the telescoping portion 40 spans across the gap between the heat sink 22 and the top 62 of the junction box 60 created by the horizontal shift of the heat sink 22. Though not visible, the vertical side walls 46 of the telescoping portion 40 do the same, spanning the gap between the heat sink 22 and the side walls 64 of the junction box 60.

Also depicted in FIG. 7 is an embodiment of the light fixture 10 in which the lighting element enclosure 20 employs horizontal flanges 54 extending inwardly from the side walls 28 of the lighting element enclosure 20. The horizontal flanges 54 preferably abut the bottom surface of the base 24 of the heat sink 22. Also preferably, the horizontal flanges 54 contain one or more slots 56 through which one or more pins or rivets 58 are disposed. In preferable embodiments, the rivets 58 are affixed to the underside of the base 24 of the heat sink 22. Thereby, the heat sink 22 moves horizontally following the slots 56 in the horizontal flanges 54. In this way, the movement of the heat sink 22 is guided and controlled using the rivet 58 and slot 56 system. For example, the horizontal movement of the heat sink 22 may be terminated when the rivet 58 reaches the end of the slot 56. Alternatively, the movement of the heat sink 22 may be terminated when it abuts one of the opposing end walls 116 of the housing 112.

In certain embodiments that employ a locking mechanism to lock the heat sink 22 in position, it is also preferable to use the horizontal flanges 54 to facilitate locking the heat sink 22. For example, in the embodiment depicted in FIG. 7, the horizontal flange 54 has an additional slot 56 through which a screw-locking mechanism 76 may be passed into the base 24 of the heat sink 22. In such embodiments, the screw-locking mechanism 76 may be tightened to lock the beat sink 22 in place and loosened again when the user wishes to shift the heat sink 22. It is not necessary to employ an additional slot, as depicted in FIG. 7, as the screw-locking mechanism 76 could simply replace the rivet 58 depicted and have the same locking effect. Those skilled in the art will recognize other variations, arrangements, features, and the like that will effectively create a locking mechanism for the heat sink 22 using the horizontal flanges 54. The present technology is not intended to be limited to the features, arrangements, and embodiments specifically described and depicted.

In comparing the preferable embodiment of the light fixture in FIGS. 6 and 7, certain important aspects of the present technology are apparent. Specifically, as depicted in FIG. 6, wherein the lighting fixture 10 is in the operation position, the base 24 of the heat sink 22 is adjacent to the junction box 60. In certain preferable embodiments, the end wall 42 of the telescoping portion 40, which is disposed substantially between the heat sink 22 and the junction box 60, is vertically aligned with one edge of the illumination aperture 30. As depicted, the distance between the base 14 of the housing 12 and the base 24 of the heat sink 22 is too small to permit removal of the lighting driver 70. In embodiments that employ a cover plate 72 and/or a driver drawer 74, the distance between the base 14 of the housing 12 and the base 24 of the heat sink 22 is similarly too small to permit removal of the cover plate 72 and/or driver drawer 74.

However, as depicted in FIG. 7, wherein the lighting fixture 10 is in the service position, the heat sink 22 has been shifted such that it is horizontally displaced from vertical alignment with the illumination aperture 30. The telescoping portion 40 is now shifted over top of the illumination aperture 30, at least in part. The increased distance between the horizontal top wall 44 of the telescoping portion 40 and the base 14 of the housing 12 permits removal of the lighting driver 70, cover plate 72, and/or driver drawer 74 through the illumination aperture 30. The shifting function of the heat sink 22 enables the removal of the lighting driver 70 for service from a low-profile, recessed light fixture 10 without unmounting the entire unit from the building's structure, accomplishing certain objectives of the present technology.

Figure 8:
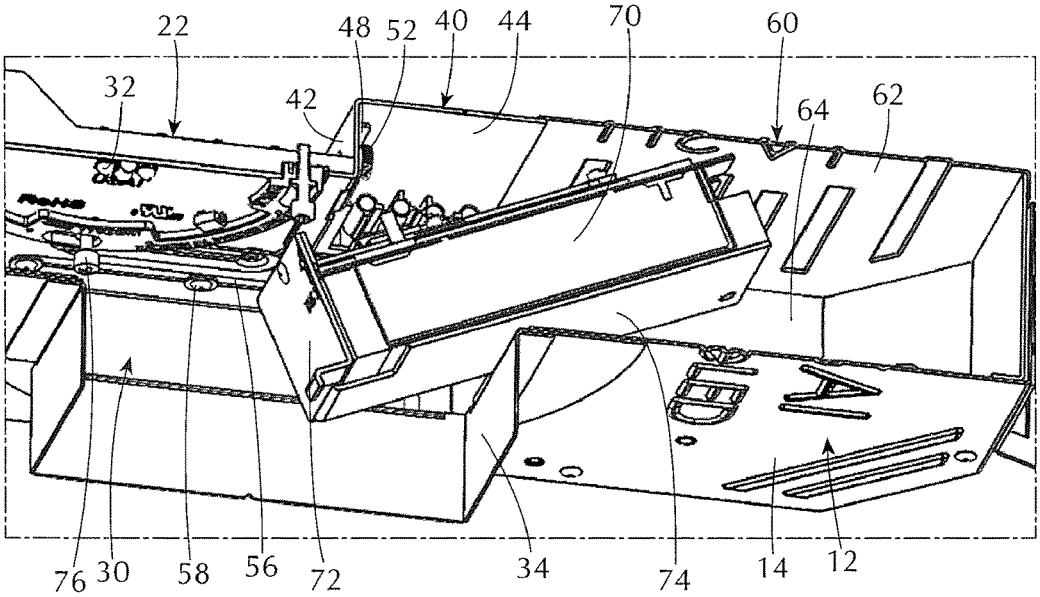
FIG. 8 is a cross-section elevation view of the light fixture constructed in accordance with exemplary embodiments of the present technology displayed in FIG. 1 and showing the light fixture in the service position with the lighting driver being removed through the illumination aperture.
Figure 9:
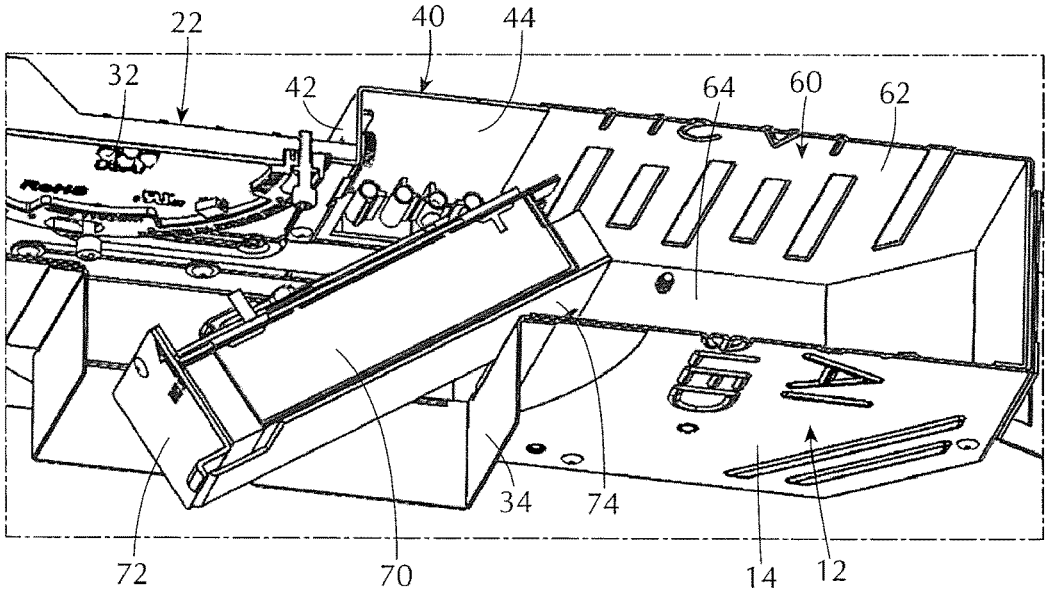
FIG. 9 is a cross-section elevation view of the light fixture constructed in accordance with exemplary embodiments of the present technology displayed in FIG. 1 and showing the light fixture in the service position with the lighting driver being removed through the illumination aperture.

Referring now to FIG. 8, the light fixture 10 is again depicted in the service position according to preferable embodiments of the technology. In FIG. 8, the lighting driver 70 and, in the depicted embodiment, the driver drawer 74, have been partially removed from the junction box 60 and are approaching the illumination aperture 30. Referring next to FIG. 9, the lighting driver 70 and driver drawer 74 are passing through the illumination aperture 30 and are now available for complete removal. Once the lighting driver 70 is clear from the illumination aperture 30, it can be serviced or replaced, and the user can also perform maintenance on any electrical components and wires remaining inside the junction box 60.

Figure 10:
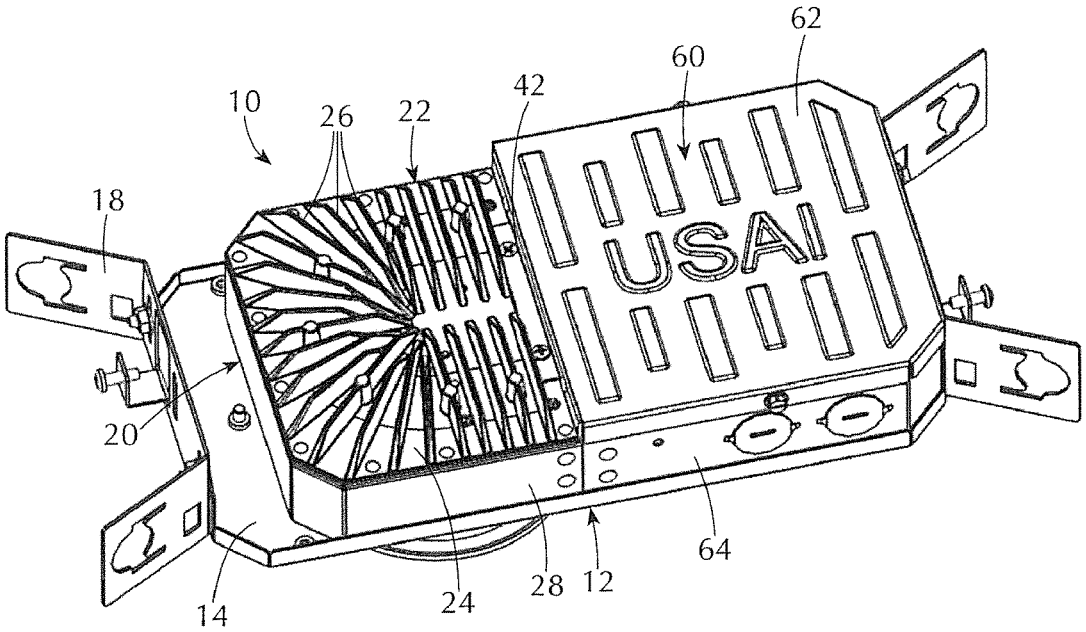
FIG. 10 is a perspective view from the top of a light fixture constructed in accordance with exemplary embodiments of the present technology and showing the light fixture in the operation position.

Referring now to FIG. 10, a preferable embodiment of the light fixture 10 according to the present technology employs a housing 12 with a base 14 and opposing end walls 16, a lighting element enclosure 20, and a junction box 60. A heat sink 22 with a base 24 and a plurality of fins 26 extending upwardly therefrom again forms the top of the lighting element enclosure 20. The light fixture 10 depicted in FIG. 10 is in the operation position, and the heat sink 22 is accordingly substantially vertically aligned with the illumination aperture 30. In addition, the telescoping portion 40 is disposed substantially entirely within the junction box 60 when the light fixture 10 is in the operation position.

Figure 11:
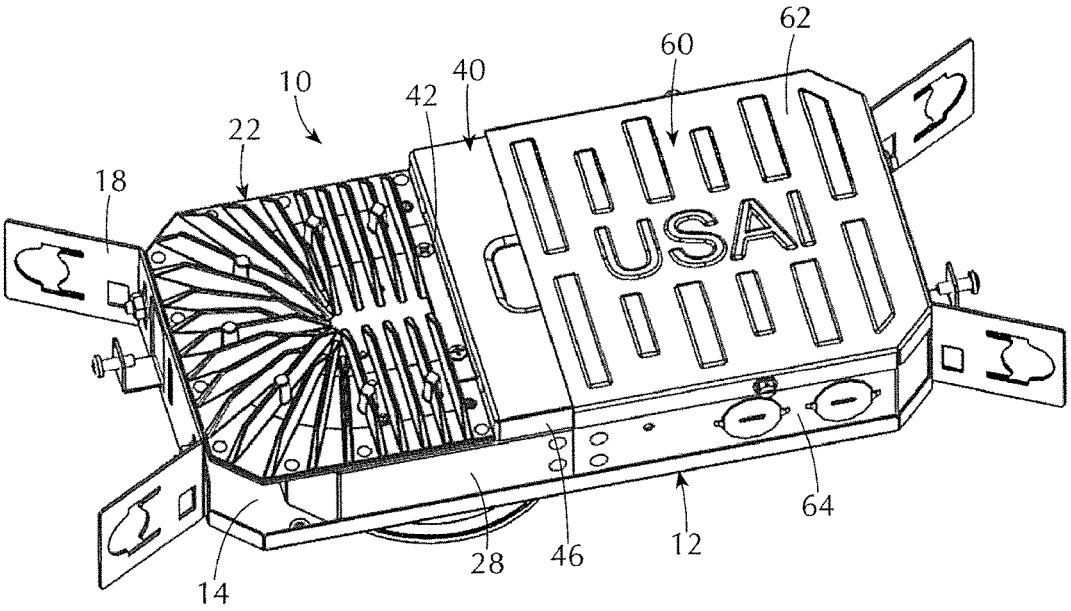
FIG. 11 is a perspective view of the light fixture constructed in accordance with exemplary embodiments of the present technology displayed in FIG. 10 and showing the light fixture in the service position.

Referring next to FIG. 11, which depicts the light fixture 10 in the service position, the heat sink 22 has shifted horizontally relative to the housing 12 such that the heat sink 22 is horizontally displaced from vertical alignment with the illumination aperture 30. The telescoping portion 40 has shifted along with the heat sink 22 such that the telescoping portion 40 is now vertically aligned with a portion of the illumination aperture 30. As depicted, the distance between the horizontal top wall 44 of the telescoping portion 40 and the base 14 of the housing 12 is substantially equivalent to the distance between the top 62 of the junction box 60 and the base 14 of the housing 12. And this distance is significantly greater than the distance between the base 24 of the heat sink 22 and the base 14 of the housing 12.

Figure 12:
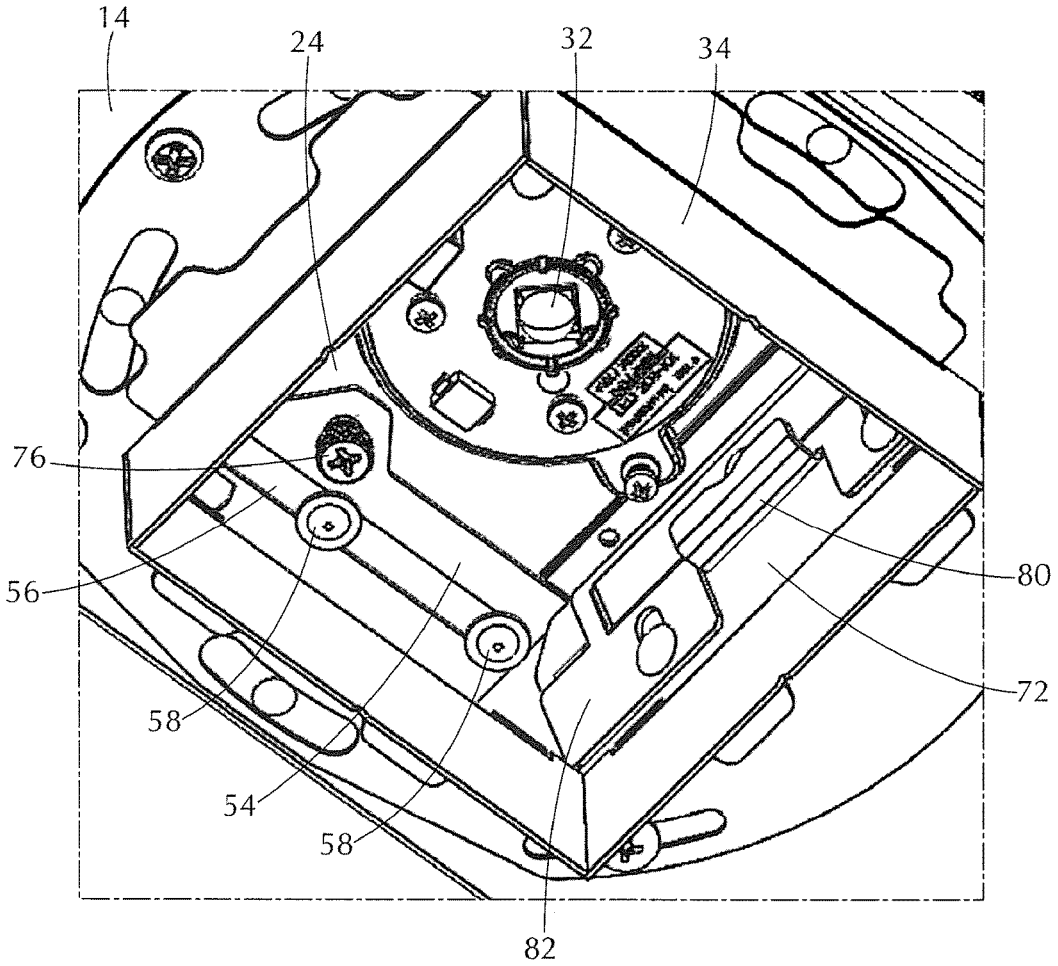
FIG. 12 is a close-up, bottom view of the light fixture constructed in accordance with exemplary embodiments of the present technology displayed in FIG. 10 and showing the light fixture in the operation position.

FIG. 12 depicts a view from below the light fixture 10 up through the illumination aperture 30 and into the lighting element enclosure 20. The embodiment of the light fixture 10 depicted in FIG. 12 is in the operation position, wherein the heat sink 22 is substantially vertically aligned with the illumination aperture 30. Visible within the lighting element enclosure 20 is one of the horizontal flanges 54 containing a slot 56 and two rivets 58 according to preferable embodiments of the technology. As shown, the rivets 58 extend through the slot 56 and into the top of the lighting element enclosure 20, which is preferably formed by the base 24 of the heat sink 22. Thus, the rivets 58 and slots 56 in the horizontal flanges 54 guide the heat sink 22 in its movements between the operation position and the service position. Also visible in FIG. 12 is the screw locking mechanism 76 for locking the heat sink 22 into place in the operation position, service position, or at any position in between. The user can tighten the screw locking mechanism 76 to lock the heat sink 22 in place or loosen the screw locking mechanism 76 to permit the heat sink to move. Those skilled in the art will recognize alternative means of locking and unlocking the heat sink 22.

Additionally visible in FIG. 12 is a cover plate 72 covering the opening to the junction box 60. The cover plate depicted employs a hook 80 and sliding portion 82 with projections to engage with projections 78 on the junction box 60. To remove the cover plate 72 depicted, the user can press down on the hook 80 to encourage the sliding portion 82 to move downwardly (using rivets and slots, as depicted, or otherwise), thereby disengaging its projections from the projections 78 on the junction box 60 (not visible in FIG. 12). Then, the hook 80 can be used to grasp and pull the cover plate 72 out of the light fixture 10 through the illumination aperture 30, thereby permitting access to the interior of the junction box 60. Other features and arrangements may also serve effectively for the removable cover plate 72, as those skilled in the art will recognize. The present technology is not limited to this or any other particularly articulated embodiment.

Figure 13:
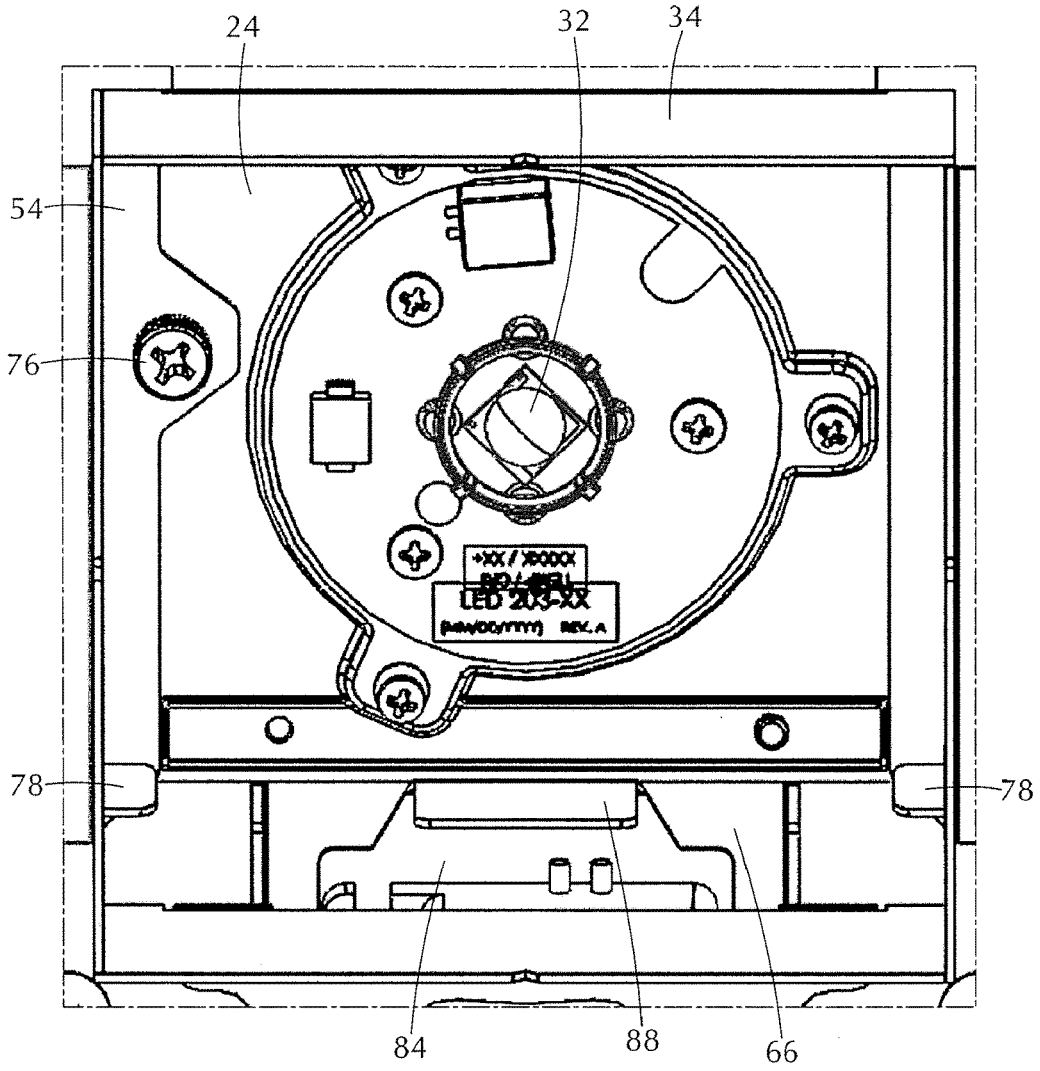
FIG. 13 is a close-up, bottom view of the light fixture constructed in accordance with exemplary embodiments of the present technology displayed in FIG. 10 and showing the light fixture during movement between the operation position and the service position.
Figure 14:
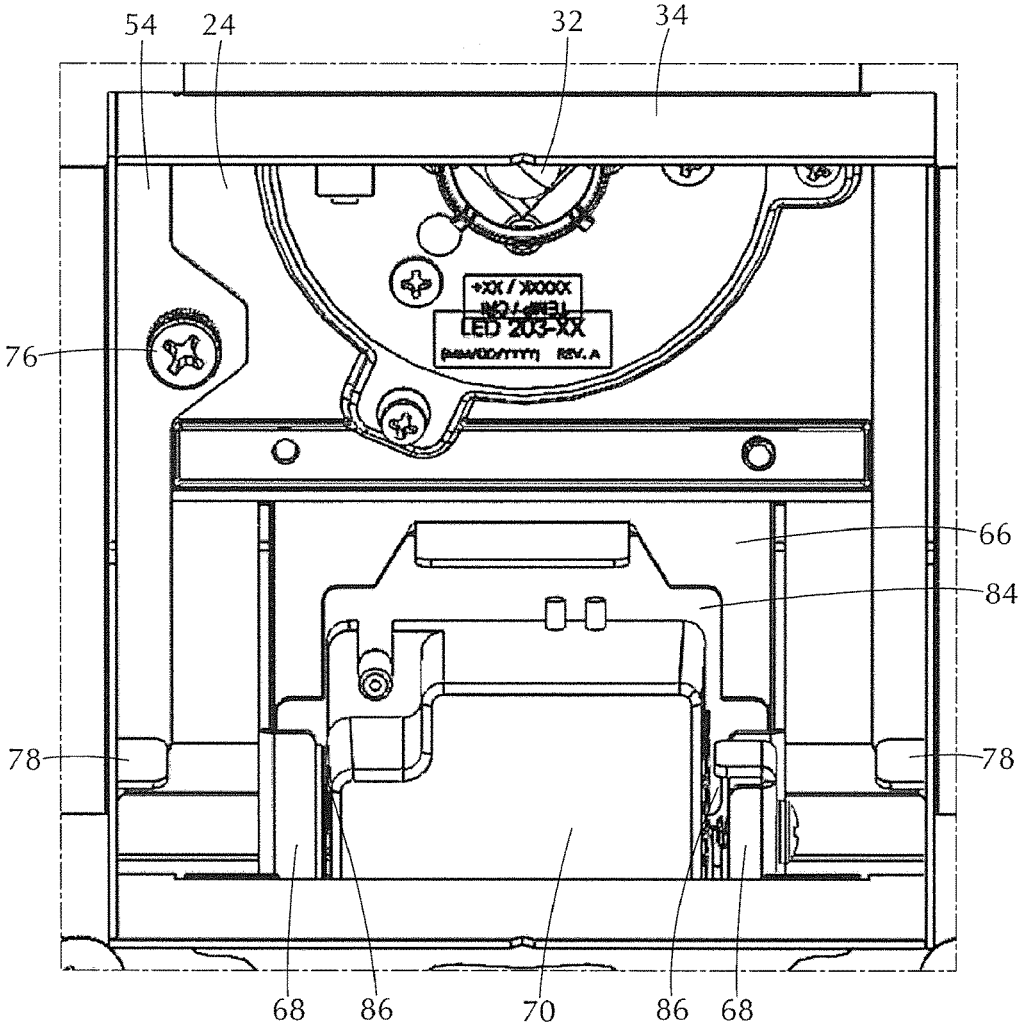
FIG. 14 is a close-up, bottom view of the light fixture constructed in accordance with exemplary embodiments of the present technology displayed in FIG. 10 and showing the light fixture in the service position.

Referring next to FIG. 13, the light fixture 10 is again depicted from below with a view through the illumination aperture 30. In FIG. 13, the cover plate 72 has been removed, revealing the projections 78 on the junction box 60, and the screw locking mechanism 76 has been loosened, preparing the heat sink 22 for a shift into the service position. Referring now to FIG. 14, the light fixture 10 is again depicted from below with a view through the illumination aperture 30, but the heat sink 22 has now been shifted into the service position. As depicted, the heat sink 22 is now horizontally displaced from vertical alignment with the illumination aperture 30.

The embodiment depicted in FIG. 14 also employs a lighting driver mount 66, preferably disposed within the junction box 60. The lighting driver mount 66 uses two opposing rails 68 to suspend the lighting driver 70 inside the junction box 60. To facilitate its suspension, the lighting driver 70 is preferably affixed to a lighting driver bracket 84 which employs projections 86 that move along the opposing rails 68 in such embodiments. To facilitate removal of the lighting driver 70, the lighting driver mount 66 is preferably affixed to the heat sink 22 such that it shifts with the heat sink 22 when the heat sink 22 moves between the operation position and the service position.

A comparison of FIGS. 13 and 14 shows how the lighting driver 70 and lighting driver mount 66 shift along with the heat sink 22. In FIG. 13, the heat sink 22 is in the operation position wherein it is substantially vertically aligned with the illumination aperture 30 and the lighting driver 70 and lighting driver mount 66 are disposed substantially entirely within the junction box 60. In FIG. 14, the heat sink 22 is in the service position wherein it is horizontally displaced from vertical alignment with the illumination aperture 30 and the lighting driver 70 and lighting driver mount 66 have shifted horizontally along with the heat sink 22 such that the lighting driver 70 and lighting driver mount 66 are partially vertically aligned with the illumination aperture 30. To complete removal of the lighting driver 70, the user simply grasps the lighting driver bracket 84, using the hook 88 or otherwise, and removes the lighting driver 70 through the illumination aperture 30. Note that the screw locking mechanism 76 can be tightened to lock the heat sink 22 in the service position, if desired.

Figure 15:
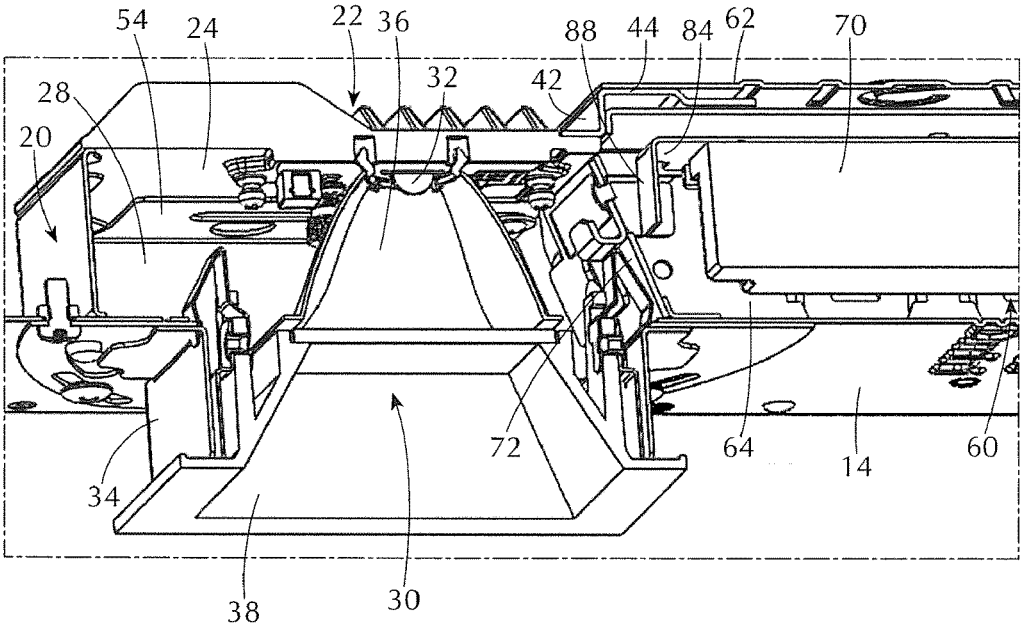
FIG. 15 is a cross-section elevation view of the light fixture constructed in accordance with exemplary embodiments of the present technology displayed in FIG. 10 and showing the light fixture in the operation position.

Referring next to FIG. 15, the light fixture 10 is depicted in the operation position according to preferable embodiments of the technology. The heat sink 22 forms the top of the lighting element enclosure 20 and is substantially vertically aligned with the illumination aperture. The telescoping portion 40, the lighting driver mount 66, and the lighting driver 70 (affixed to the lighting driver bracket 84) are all substantially disposed within the junction box 60. The cover plate 72 is engaged closing off access to the interior of the junction box 60 through the illumination aperture 30. Also depicted are the vertical aperture flanges 34 extending down from the illumination aperture 30 as well as the reflector 36 and trim 38.

Figure 16:
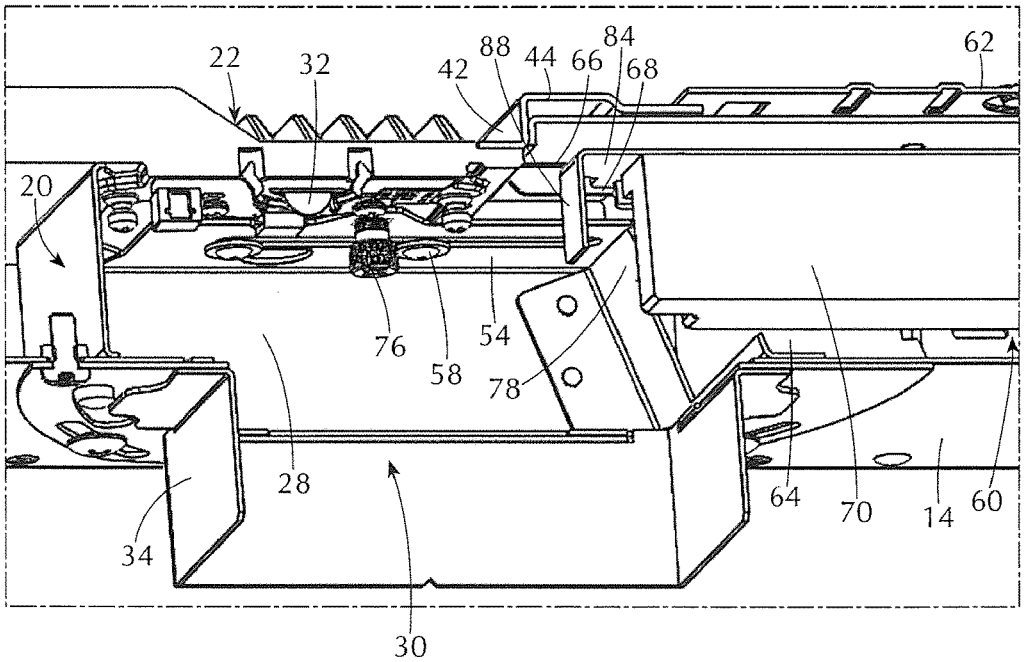
FIG. 16 is a cross-section elevation view of the light fixture constructed in accordance with exemplary embodiments of the present technology displayed in FIG. 10 and showing the light fixture in the service position.

Referring next to FIG. 16, the light fixture 10 is depicted in the service position according to preferable embodiments of the technology. The reflector 36 and trim 38 have been removed to provide the user access to the interior of the housing 12 through the illumination aperture 30. The heat sink 22 has been shifted horizontally such that it is horizontally displace from vertical alignment with the illumination aperture 30, placing the light fixture 10 in the service position. The telescoping portion 40 and lighting driver mount 66 have shifted along with the heat sink 22, a preferable embodiment of the technology. The telescoping portion 40 extends to maintain a contiguous enclosure when the light fixture 10 is in the service position. More specifically, the horizontal top wall 44 of the telescoping portion 40 spans across the gap between the heat sink 22 and the top 62 of the junction box 60 and the vertical side walls 46 of the telescoping portion 40 span across the gap between the heat sink 22 and the side walls 64 of the junction box 60.

As seen by comparing the preferable embodiments depicted in FIGS. 15 and 16, the horizontal shift of the heat sink 22 into the service position facilitates access to the lighting driver 70 and other electrical components and wires in the junction box 60 by increasing the distance between the base 14 of the housing 12 and the top of the light fixture 10. Specifically, the distance between the base 24 of the heat sink 22 and the base 14 of the housing 12 is significantly smaller than the distance between the top 62 of the junction box 60—as well as the horizontal top wall 44 of the telescoping portion 40, which is located at substantially the same height—and the base 14 of the housing 12. Thus, when the light fixture 10 is in the operation position with the heat sink 22 substantially vertically aligned with the illumination aperture 30, there is significantly less space to access the junction box 60, as depicted in FIG. 15. But when the light fixture 10 is in the service position with the heat sink 22 horizontally displaced from vertical alignment with the illumination aperture 30 and the telescoping portion 40 partially vertically aligned with the illumination aperture, there is significantly more space to access the junction box 60 and remove the lighting driver 70, as depicted in FIG. 16.

Figure 17:
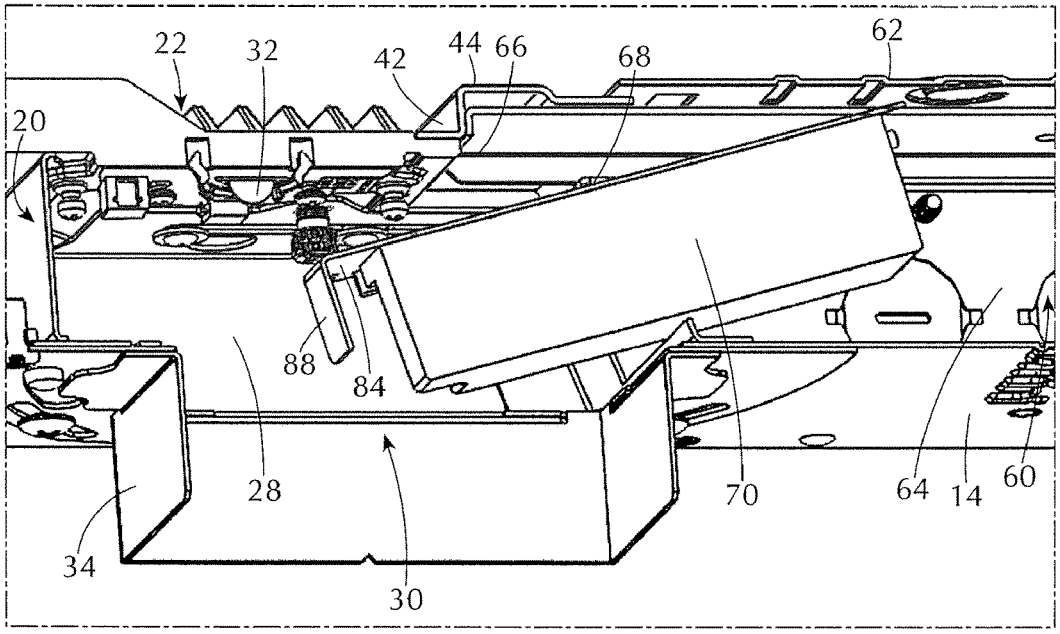
FIG. 17 is a cross-section elevation view of the light fixture constructed in accordance with exemplary embodiments of the present technology displayed in FIG. 10 and showing the light fixture in the service position with the lighting driver being removed through the illumination aperture.
Figure 18:
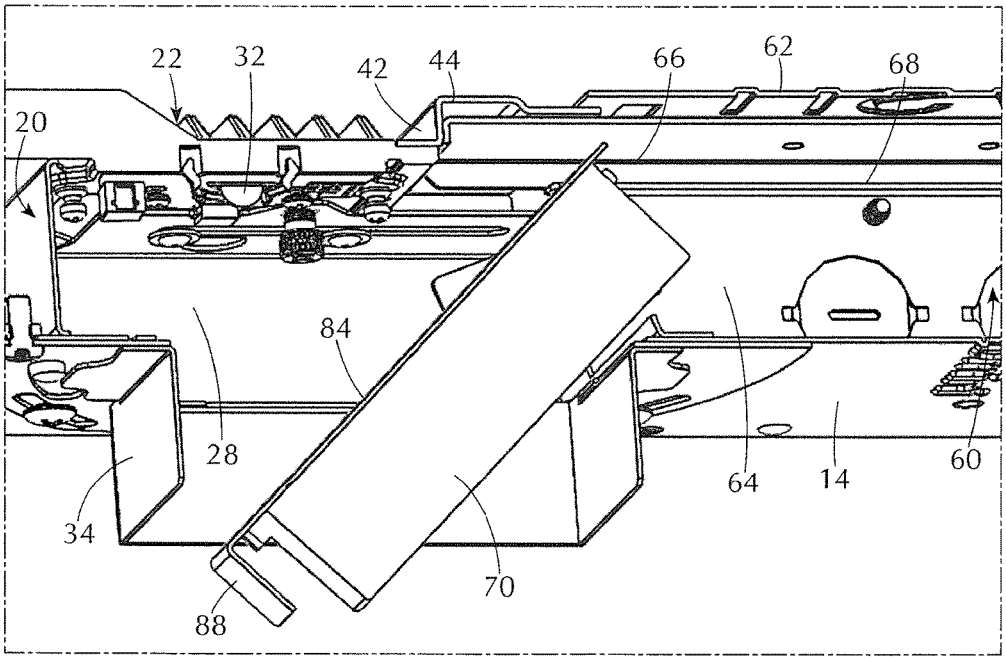
FIG. 18 is a cross-section elevation view of the light fixture constructed in accordance with exemplary embodiments of the present technology displayed in FIG. 10 and showing the light fixture in the service position with the lighting driver being removed through the illumination aperture.

Referring now to FIG. 17, the light fixture 10 is again depicted in the service position according to preferable embodiments of the technology. In FIG. 8, the lighting driver 70 and lighting driver bracket 84 have been partially removed from the junction box 60. Referring next to FIG. 18, the lighting driver 70 and lighting driver bracket 84 are passing through the illumination aperture 30. Once the lighting driver 70 is clear from the illumination aperture 30, it can be serviced or replaced, and the user can also perform maintenance on any electrical components and wires remaining inside the junction box 60.

Referring now to FIGS. 19-28, a preferable embodiment of the lighting fixture 110 according to exemplary embodiments of the present technology is depicted, with the light fixture 110 in the operation position. The light fixture 110 employs a housing 112 with a base 114 and opposing side walls 190. Preferable embodiments of the housing 112 also have opposing end walls 116 upon which unit mounting brackets 118 may be attached.

Figure 19:
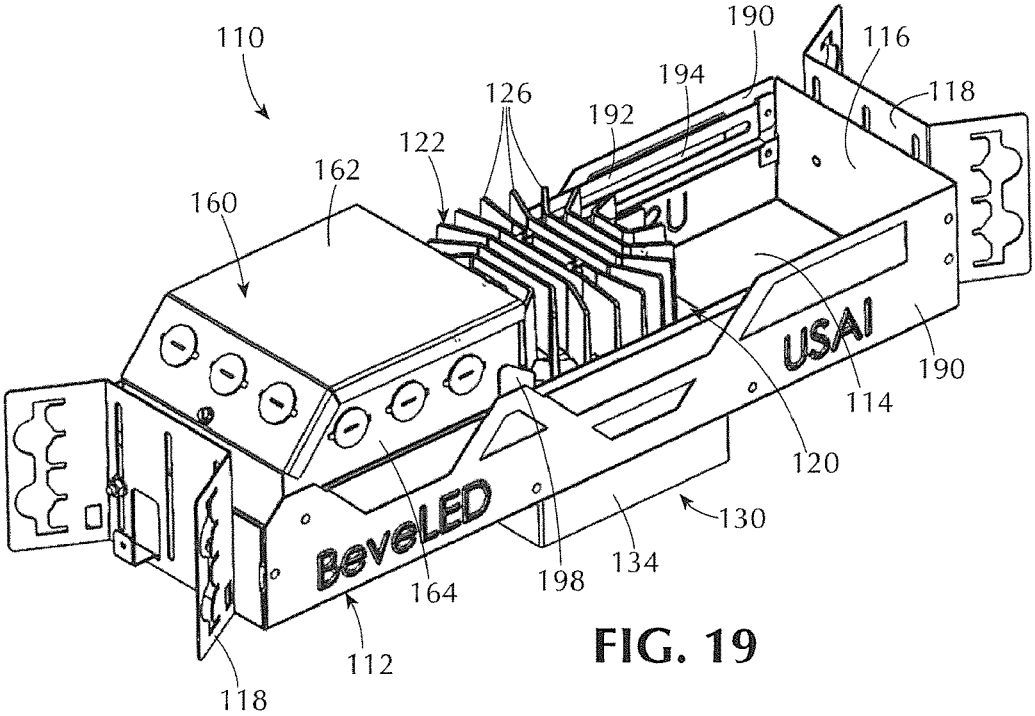
FIG. 19 is a perspective view from the top of a light fixture constructed in accordance with exemplary embodiments of the present technology and showing the light fixture in the operation position.

The preferable embodiment of the light fixture 110 depicted in FIG. 19 also employs a lighting element enclosure 120 and a junction box 160, both disposed within the housing 112, as well as a heat sink 122 with a base 124 and a plurality of fins 126 extending upwardly from the base 124. The base 124 of the heat sink 122 preferably forms the top of the lighting element enclosure 120. Alternatively, the base 124 of the heat sink 122 may be affixed to the top of the lighting element enclosure 120. A lighting element (not shown) such as those depicted above is preferably affixed to the bottom surface of the base 124 of the heat sink 122 and disposed within the lighting element enclosure 120, though it may instead be affixed to the bottom surface of the top of the lighting element enclosure 120.

The lighting element enclosure 120 is movable laterally horizontally and vertically relative to the base 114 and the junction box 160 is movable laterally relative to the base 114.

To guide movement of the movement of the lighting element enclosure 120 and the junction box 160, the opposing side walls 190 of the housing 112 each preferably have a guide rail 192. The guide rails contain slots 194 which guide the movement of the lighting element enclosure between and amongst an operation position, an intermediate position, and a service position. One or more pins 196 project outwardly from the side walls 128 of the lighting element enclosure 120 in preferable embodiments of the technology. The pins 196 extend into the slots 194 in the guide rails 192 to control the movement of the lighting element enclosure 120 relative to the housing 112.

In preferable embodiments, the junction box 160 similarly has one or more pins 196 extending outwardly from its side walls 164. The pins 196 of the junction box 160 likewise extend into the slots 194 in the guide rails 192 to control the movement of the junction box 160 relative to the housing 112. In preferable embodiments, the movement of the junction box 160 in a horizontal direction is tied to the movement of the lighting element enclosure 120 in the horizontal direction. In such preferable embodiments, the lighting element enclosure 120 is also free to move in a vertical direction when in certain positions while the junction box 160 only moves horizontally relative to the housing 112.

In preferable embodiments, the slots 194 in the guide rails 192 operate to determine the lower-most vertical position the lighting element enclosure 120 can reach, defining the operation position. From the operation position, the guide rails 192 preferably limit the movement of the lighting element enclosure 120 to a vertical upward direction relative to the base 114 of the housing 112.

More specifically, each guide rail 192 has a laterally-extending horizontal portion intersected by a pair of spaced-apart vertical portions depending downwardly from the horizontal portion, forming a T-shaped slot 194 with two downwardly-depending legs. The vertical portions having upper and lower ends and the upper ends are aligned with the horizontal portion. The junction box 160 has a pair of guide pins 196 on each of two opposing sides thereof, and each pair is adapted to engage and slide in the horizontal portion of one of the guide rails 192. The lighting element enclosure 120 has a pair of guide pins 196 on each of two opposing sides thereof, and each pair is adapted to engage and slide in the horizontal and vertical portions of one of the guide rails 192.

Figure 22:
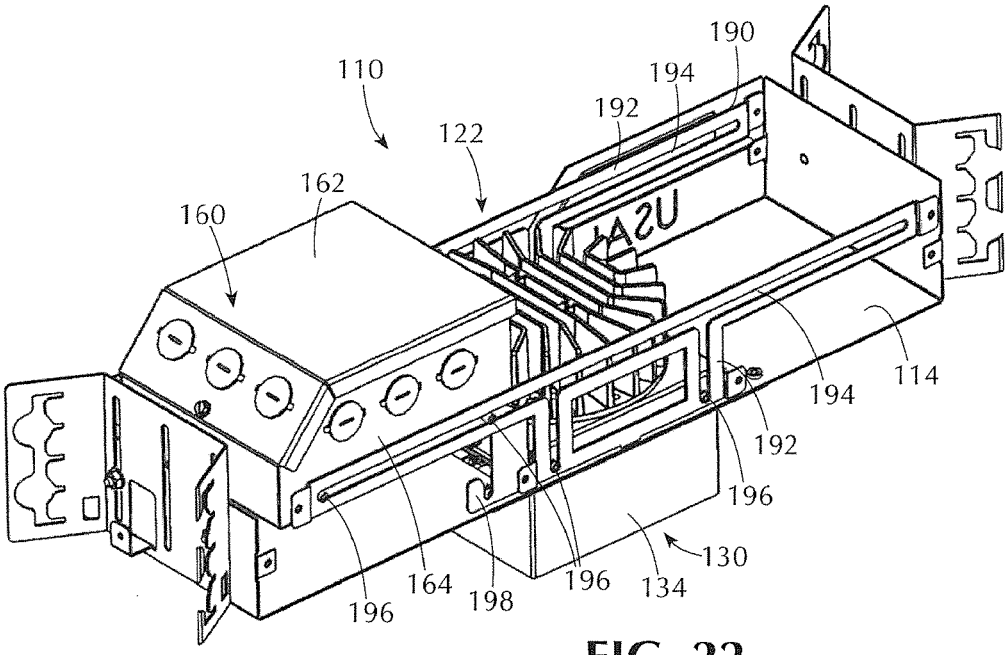
FIG. 22 is a cross-sectional perspective view from the top of the light fixture constructed in accordance with exemplary embodiments of the present technology displayed in FIG. 19 and showing the light fixture in the operation position.
Figure 24:
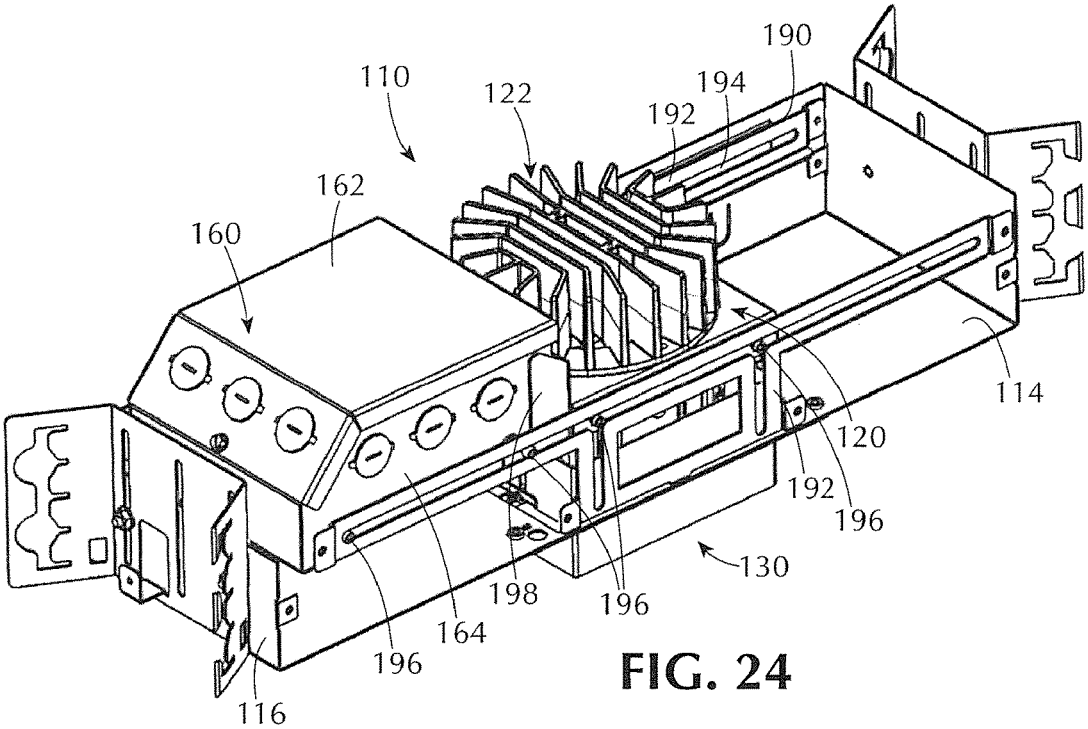
FIG. 24 is a cross-sectional perspective view from the top of the light fixture constructed in accordance with exemplary embodiments of the present technology displayed in FIG. 19 and showing the light fixture in the intermediate position.
Figure 25:
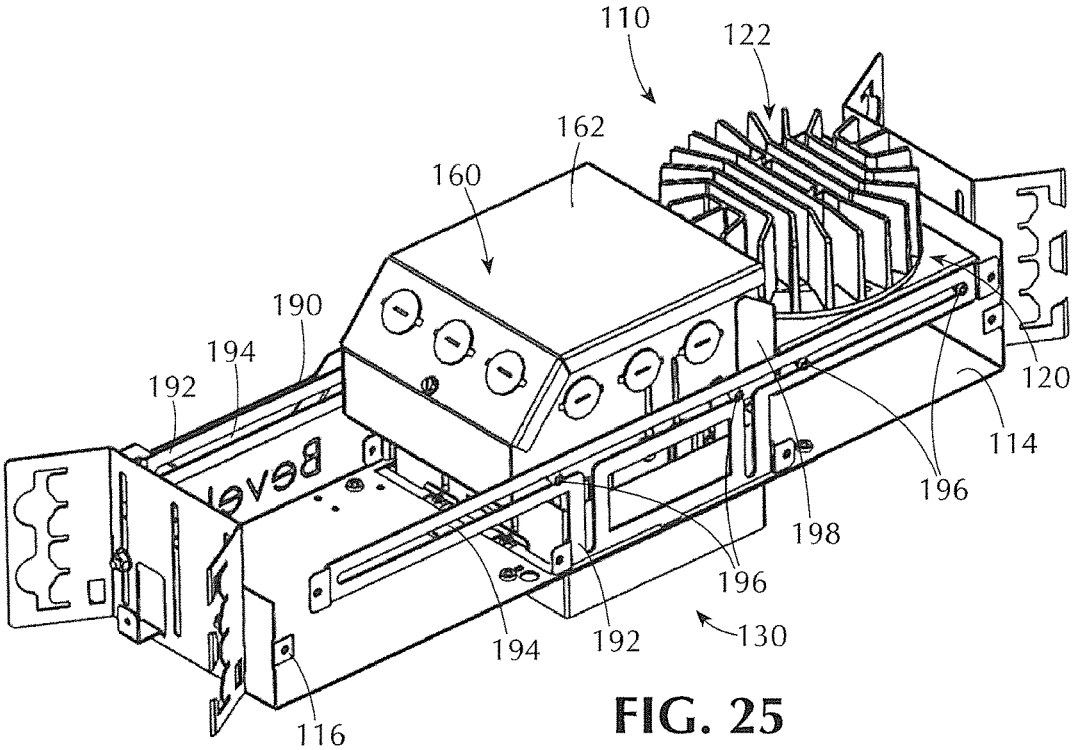
FIG. 25 is a cross-sectional perspective view from the top of the light fixture constructed in accordance with exemplary embodiments of the present technology displayed in FIG. 19 and showing the light fixture in the service position.

When the light fixture 10 is in the operation position as depicted in FIG. 22, the guide pins 196 of the lighting element enclosure 120 are disposed at the lower ends of the vertical portions of an associated guide rail 192. When the light fixture 10 is in the intermediate position as depicted in FIG. 24, the guide pins 196 of the lighting element enclosure 120 are disposed at the upper ends of the vertical portions of the associated guide rail 192. When the light fixture 10 is in the service position as depicted in FIG. 25, the guide pins 196 of the lighting element enclosure 120 are disposed in the horizontal portion of the associated guide rail 192, and are laterally displaced from the vertical portions thereof.

In the operation position, as depicted in FIGS. 19 and 22, the lighting element enclosure 120 is substantially vertically aligned with the illumination aperture 130 disposed in the base 114 of the housing 112, and the lighting element 132 is aligned with a center of the illumination aperture 130. This arrangement allows light emitted from the lighting element 132, disposed within the lighting element enclosure 120, to project through the illumination aperture 130. When in the operation position, the lighting element enclosure 120 is also at the lower-most vertical position relative to the base 114 of the housing 112. The junction box 160 is laterally displaced from the illumination aperture 130 in a first direction (to the left of the illumination aperture as depicted).

Figure 20:
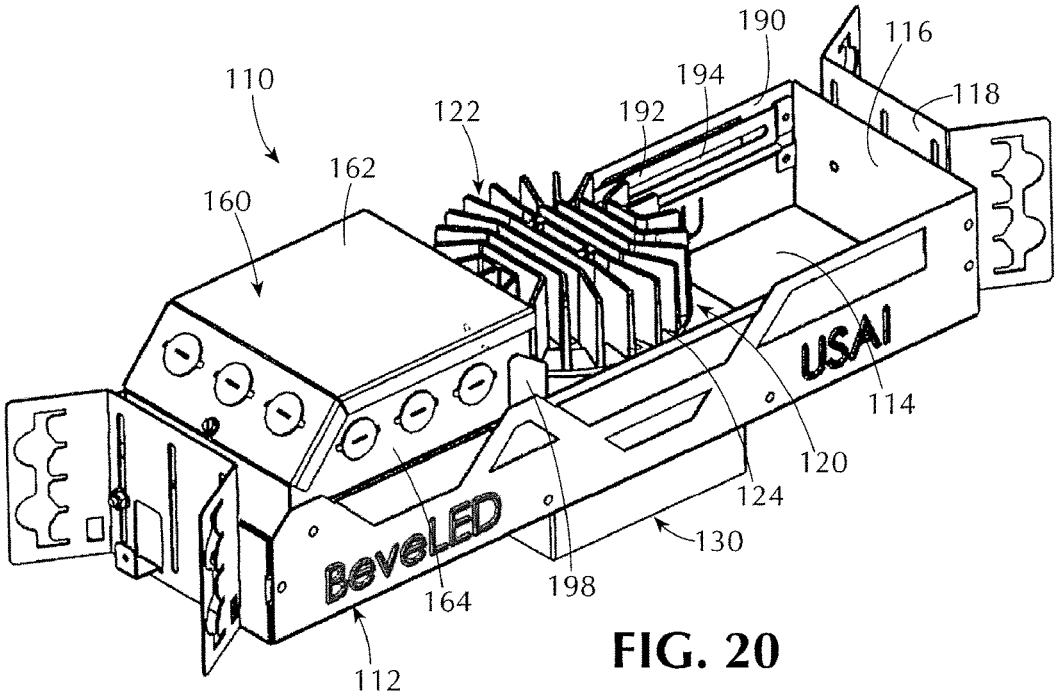
FIG. 20 is a perspective view from the top of the light fixture constructed in accordance with exemplary embodiments of the present technology displayed in FIG. 19 and showing the light fixture in the intermediate position.

Referring next to FIGS. 20 and 24, the light fixture 110 is depicted after light fixture 110 has been shifted into the intermediate position. In the intermediate position, the lighting element enclosure 120 is still substantially vertically aligned with the illumination aperture 130, as depicted. However, the lighting element enclosure 120 is at the upper-most vertical position relative to the base 114 of the housing 112 when in the intermediate position. In other words, the movement of the lighting element enclosure 120 between the operation position and the intermediate position is a strictly vertical movement. The lighting element enclosure 120 does not move horizontally between the operation position and the intermediate position. The junction box 160 does not move during transition between the operation and intermediate positions. Specifically, when the light fixture 10 is in the intermediate position, the junction box 160 is (remains) laterally displaced from the illumination aperture 130 in a first direction (to the left of the illumination aperture as depicted).

Again, in preferable embodiments, the slots 194 in the guide rails 192 operate to control the movement of the lighting element enclosure 120 between the operation position and intermediate position. The guide rails 192 determine the upper-most vertical position of the lighting element enclosure 120 and preclude any horizontal movement between the operation position and the intermediate position. Furthermore, though not visible in FIG. 20, in certain preferable embodiments, once the lighting element enclosure 120 reaches the intermediate position, the lighting element enclosure 120 engages with the junction box 160 so that both shift together during lateral horizontal movement from the intermediate position to the service position. Engagement of the lighting element enclosure 120 and the junction box 160 can occur using several arrangements of features, including a hook-and-pin method, a rivet-and-slot method, or other variations. Alternatively, the junction box 160 may also shift vertically along with the lighting element enclosure 120 between the operation position and the intermediate position. Those skilled in the art will recognize the various alterations possible, and the present technology is not intended to be limited to any particular arrangement or embodiment.

From the intermediate position, the lighting element enclosure 120 shift to the service position by moving laterally horizontally, or can return to the operation position by moving vertically downward. In preferable embodiments, these movements are controlled using the guide rails 192.

Figure 21:
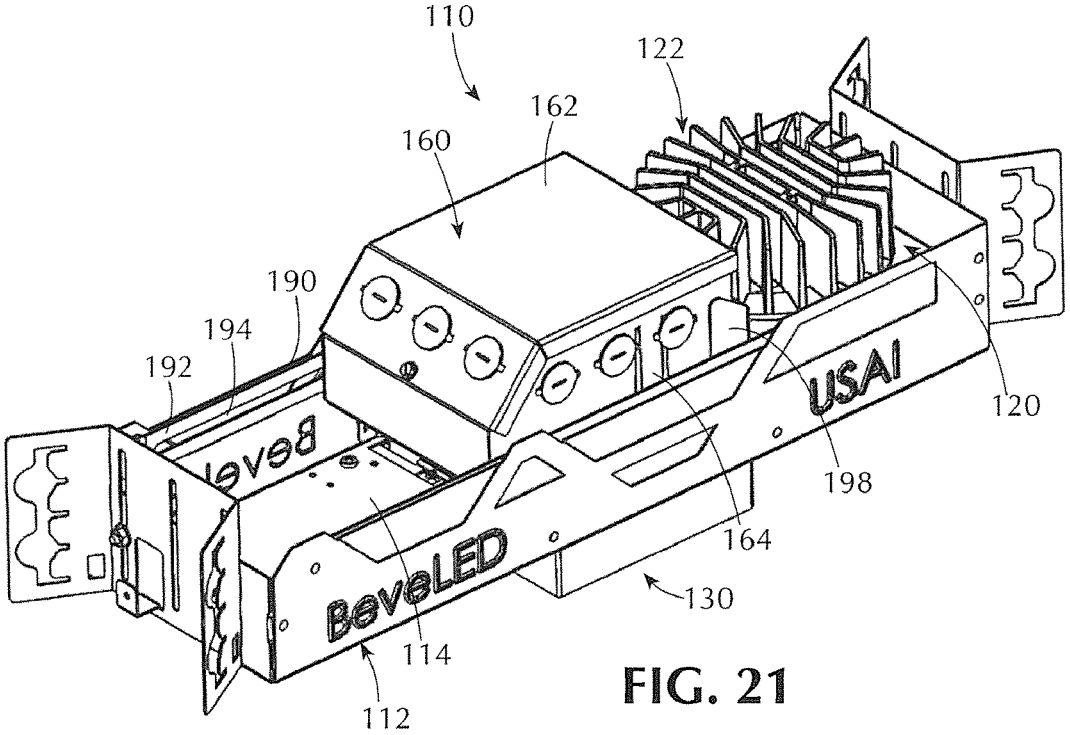
FIG. 21 is a perspective view from the top of the light fixture constructed in accordance with exemplary embodiments of the present technology displayed in FIG. 19 and showing the light fixture in the service position.

Referring next to FIG. 21, the light fixture 110 is depicted with the lighting element enclosure 120 and the junction box 160 in the service position. As shown, when the lighting element enclosure 120 is in the service position, it is laterally horizontally displaced from vertical alignment with the illumination aperture 130 in a second direction (i.e., to the right of the illumination aperture). And the junction box 160 has also shifted laterally in the second direction and is in vertical alignment with the illumination aperture 130, permitting the user to access the underside of the junction box 160.

In preferable embodiments of the technology, the guide rails 192 control the movement of the lighting element enclosure 120 and the junction box between the intermediate position and the service position. Specifically, the slots 194 in the guide rails 192 preferably permit movement only in a directly horizontal direction and create an end point defining the service position, at which end point the lighting element enclosure 120 can shift no further.

FIG. 22 provides a cross-sectional perspective view of the guide rail 192 system provided in the housing 112 of preferable embodiments of the technology. As shown, the side walls 128 of the lighting element enclosure 120 employ pins 196 projecting outwardly and into the slots 194 of the guide rails 192. The slots 194 in the guide rails 192 restrict the movement of the lighting element enclosure 120 among the three positions: in the operation position, the lighting element enclosure 120 can only move vertically up to the intermediate position; from the intermediate position, the lighting element enclosure 120 can move either vertically down to the operation position or laterally horizontally to the service position; and from the service position, the lighting element enclosure 120 can only move horizontally back to the intermediate position.

As depicted, the junction box 160 also employs pins 196 projecting outwardly from its side walls 164 and into the slots 194 of the guide rails 196. In the preferable embodiment depicted in FIG. 22, the guide rails 192 permit the junction box 160 to move only in the lateral horizontal direction. In such preferable embodiments, the junction box 160 is preferably adapted to engage with the lighting element enclosure 120 so that both the junction box 160 and the lighting element enclosure 120 move together laterally among the intermediate and service positions.

To that end, the preferable embodiment of the lighting element enclosure 120 depicted in FIG. 22 employs one or more hooks 198 that are adapted to engage with the pins 196 of the junction box 160 as the lighting element enclosure 120 moves in the vertical direction from the operation position to the intermediate position. The hooks 198 of the lighting element enclosure 120 are preferably upwardly-open such that they partially surround the pins 196 of the junction box 160 as they move up along with the lighting element enclosure 120. This process is apparent when comparing FIGS. 22-25.

Figure 23:
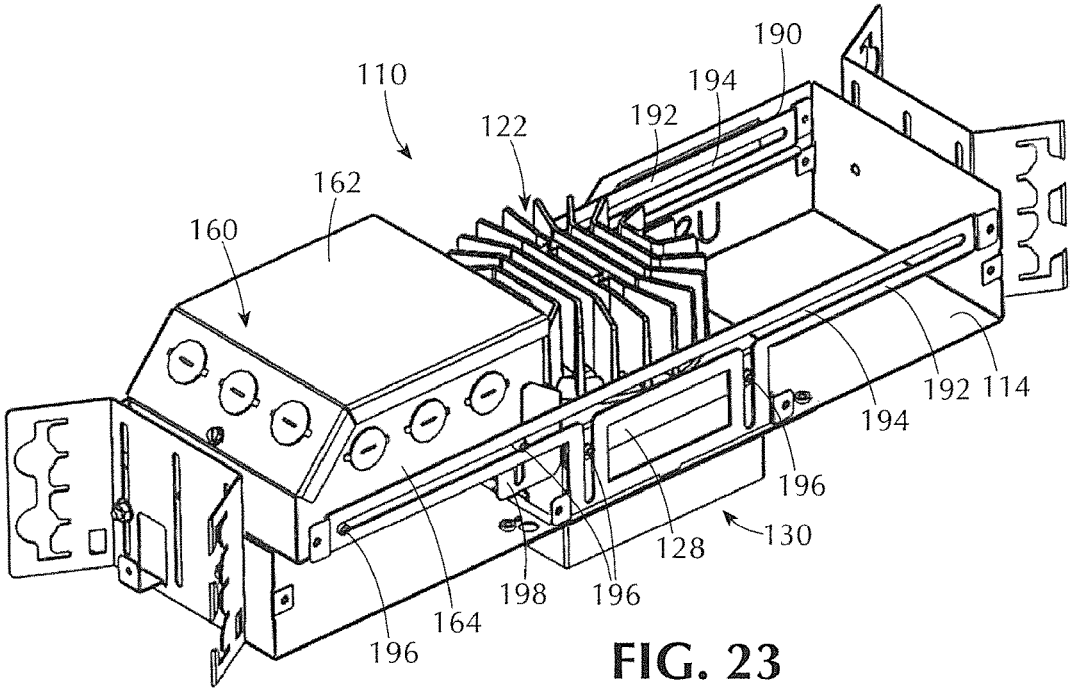
FIG. 23 is a cross-sectional perspective view from the top of the light fixture constructed in accordance with exemplary embodiments of the present technology displayed in FIG. 19 and showing the light fixture positioned between the operation and intermediate positions.

In FIG. 22, the light fixture 110 is in the operation position, with the lighting element enclosure 120 located at the lower-most vertical position permitted by the guide rails 192. The hooks 198 of the lighting element enclosure 120 are likewise at the lower-most vertical position and are not engaged with the pins 196 of the junction box 160. As the lighting element enclosure 120 shifts upwardly toward the intermediate position, as depicted in FIG. 23, the hooks 198 shift upwardly as well. Once the lighting element enclosure 120 reaches the intermediate position, as depicted in FIG. 24, the hooks 198 of the lighting element enclosure 120 engage with the pins 196 of the junction box 160, as shown. The lighting element enclosure 120 can now move laterally horizontally into the service position or return back down vertically to the operation position, as the slots 194 in the rails 192 allow either movement direction from the intermediate position. If the lighting element enclosure 120 moves back down, returning to the operation position, the hooks 198 of the lighting element enclosure 120 disengage with the pins 196 of the junction box 160 and the lighting element enclosure 120 will therefore move independently of the junction box 160 among the operation and intermediate positions. If, instead, the lighting element enclosure 120 shifts horizontally into the service position, the hooks 198 of the lighting element enclosure 120, which are engaged with the pins 196 of the junction box 160, will cause the junction box 160 and the lighting element enclosure 120 to shift simultaneously, as depicted in FIG. 25.

While the hook-and-pin embodiment depicted in FIGS. 22-25 is a preferred embodiment, certain other variations may be equally effective. For example, slots running vertically could be disposed in the side walls 164 of the junction box 160 and the side walls 128 of the lighting element enclosure 120 could employ arms with rivets that enter the slots in the side walls 164 of the junction box 160. In such an arrangement, as the lighting element enclosure 120 shifts vertically from the operation position to the intermediate position, the rivets might simply shift within the slots without altering the position of the junction box 160. Then, when the lighting element enclosure 120 shifts horizontally from the intermediate position to the service position, the rivets would engage the junction box 160 to move horizontally as well. Or, in some embodiments, the junction box 160 might shift both horizontally and vertically with the lighting element enclosure 120 or might shift entirely independent of the lighting element enclosure 120. Those skilled in the art will recognize alternative embodiments, all of which are included in the principles of the present technology.

Figure 26:
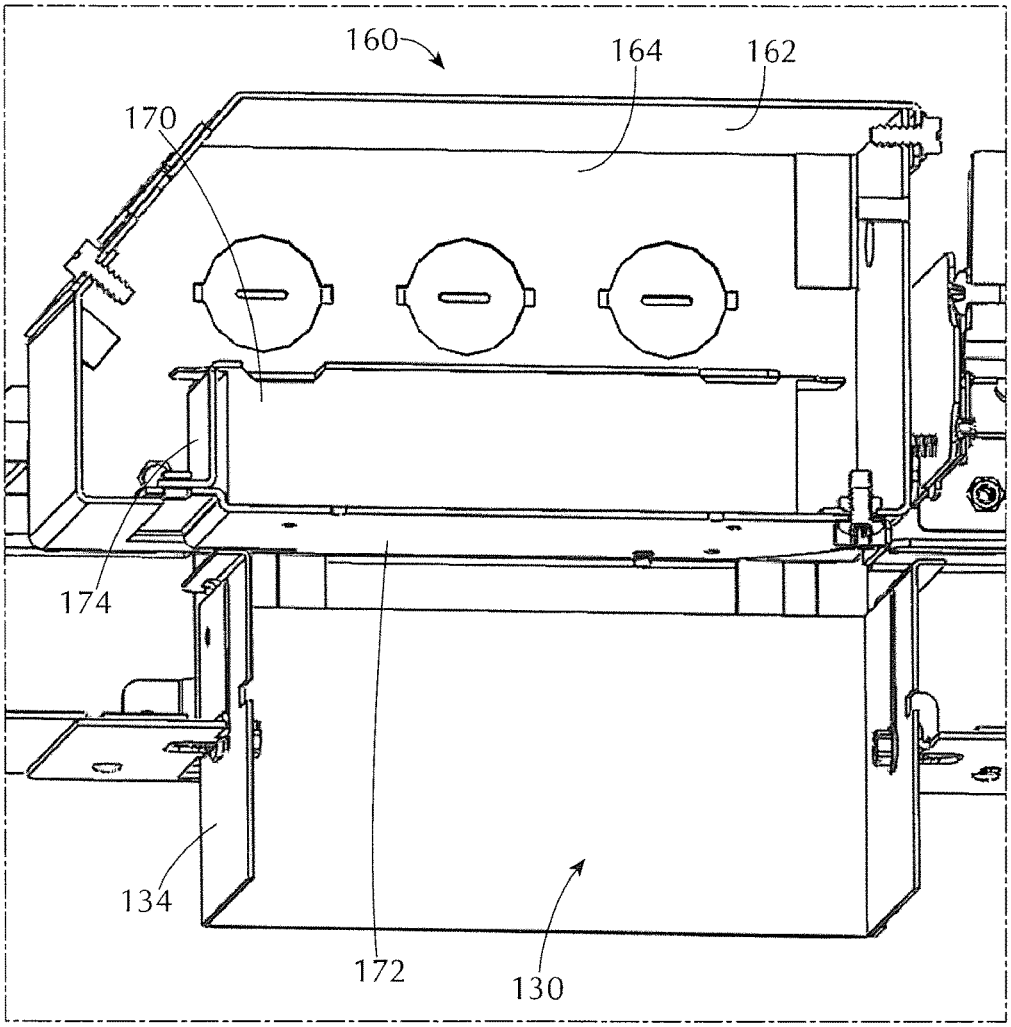
FIG. 26 is a cross-sectional elevation view of the light fixture constructed in accordance with exemplary embodiments of the present technology displayed in FIG. 19 and showing the light fixture in the service position.

Referring next to FIG. 26, a preferable embodiment of the light fixture 110 in the service position is depicted. FIG. 26 depicts a close-up, cross-sectional, elevation view of the junction box 160. The junction box 160 is substantially vertically aligned with the illumination aperture 130 when in the service position, allowing the user to access the bottom of the junction box 160 through the illumination aperture 130. A hole in the bottom of the junction box 160 permits the user to access the lighting driver 170 and other electrical components and wires disposed within the junction box 160.

In preferable embodiments, the hole in the bottom of the junction box 160 is covered by a cover plate 172. Preferably, the cover plate 172 must be removed to access the interior of the junction box 160 and can only be removed when the junction box 160 is in the service position. In some embodiments, the cover plate 172 may also employ a locking mechanism, such as a screw, hook, snap, slider, etc. that must be disengaged in order to remove it. Furthermore, in certain preferable embodiments, the lighting driver 170 may be affixed to the cover plate 172 using a driver bracket 174. In such embodiments, the lighting driver 170 and cover plate 172 may be removed simultaneously from the junction box 160 through the illumination aperture 130 for service.

Figure 27:
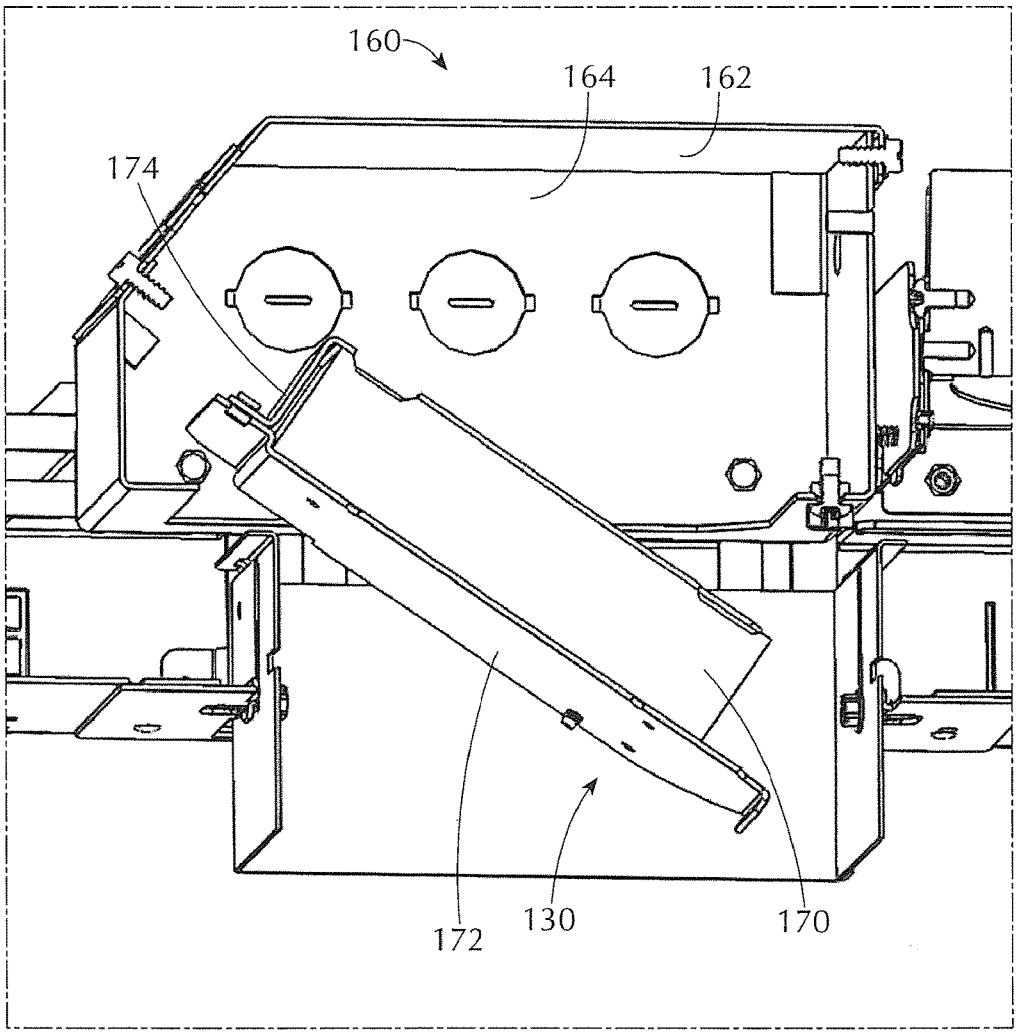
FIG. 27 is a cross-sectional elevation view of the light fixture constructed in accordance with exemplary embodiments of the present technology displayed in FIG. 19 and showing the light fixture in the service position with the lighting driver being removed through the illumination aperture.
Figure 28:
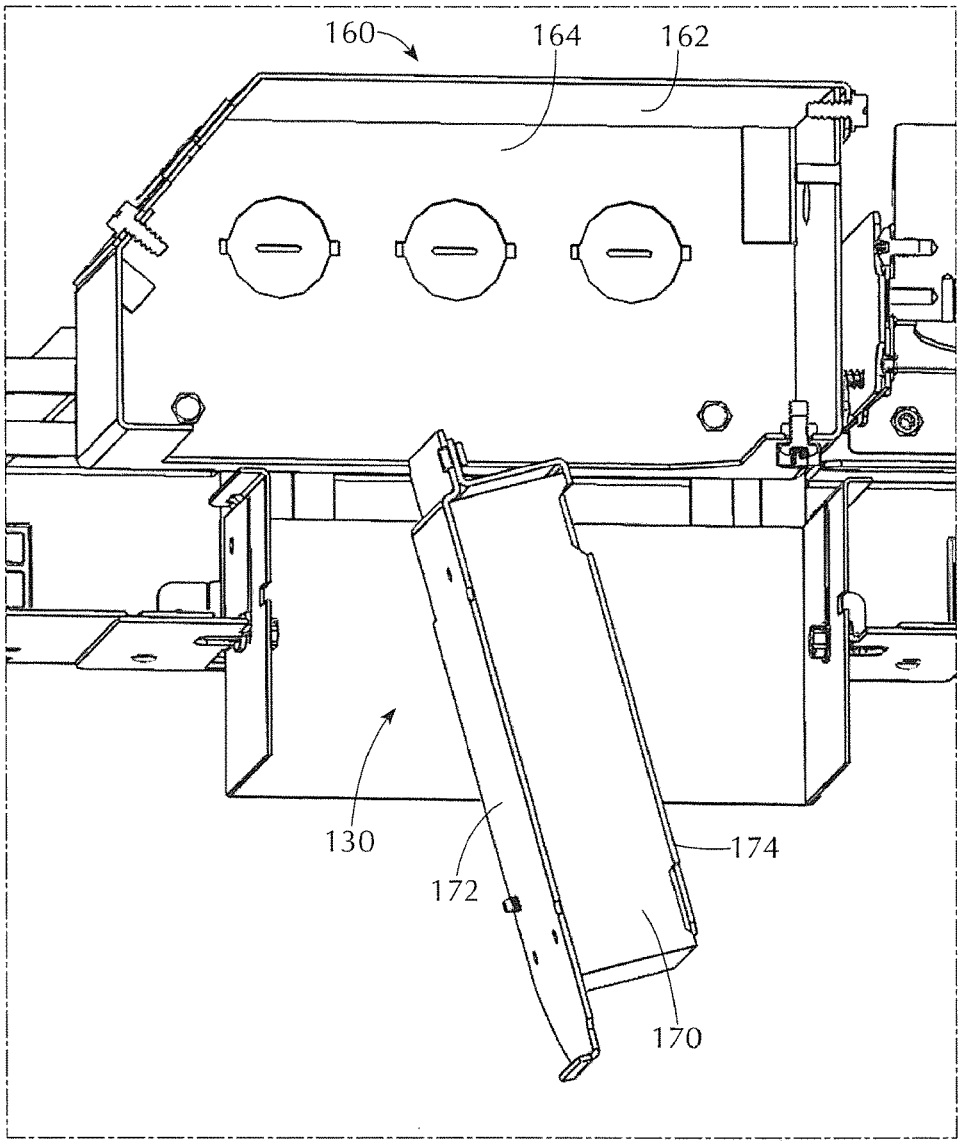
FIG. 28 is a cross-sectional elevation view of the light fixture constructed in accordance with exemplary embodiments of the present technology displayed in FIG. 19 and showing the light fixture in the service position with the lighting driver being removed through the illumination aperture.

In FIG. 26, the cover plate 172 is still engaged with the bottom of the junction box 160 and the lighting driver 170 and other electrical components and wires are still disposed securely within the junction box 160. Referring next to FIG. 27, the cover plate 172 has been disengaged and the lighting driver 170 and cover plate 172 have been partially removed from the junction box 160 and are approaching the illumination aperture 130; the lighting driver 170 is affixed to the cover plate 172 using the driver bracket 174 in the embodiment depicted in FIGS. 26-28. Referring to FIG. 28, the lighting driver 170 and cover plate 172 are passing through the illumination aperture 130 and are now available for complete removal. As noted above, in certain embodiments, including those depicted in FIGS. 26-28, the user must take care to avoid collision of the lighting driver 170 with the vertical aperture flanges 134 that extend downwardly from the base 114 of the housing 112.

With the lighting driver 170 removed from the light fixture 110, maintenance can be performed on the lighting driver 170 itself as well as the other electrical components and wires remaining in the junction box 160. The maintenance can be performed without removing the light fixture 110 from the wall or ceiling, accomplishing the objectives of the technology. While the present technology has been described with reference to particular embodiments and arrangements of parts, features, and the like, the present technology is not limited to these embodiments or arrangements. Indeed, many modifications and variations will be ascertainable to those of skill in the art, all of which are inferentially included in these teachings.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed is:

1. A low-profile light fixture comprising:

a housing having a base with an illumination aperture, a lighting element enclosure disposed over the illumination aperture, and a junction box disposed laterally adjacent the light element enclosure;

a heat sink having a base and a plurality of fins extending therefrom, a lower surface of the base of the heat sink forming a top of the lighting element enclosure, and the heat sink being movable laterally relative to the junction box;

a lighting element disposed within the lighting element enclosure and mounted to the base of the heat sink;

a lighting driver disposed within the junction box;

a telescoping portion connected to the heat sink;

the light fixture having an operation position and a service position;

in the operation position, the heat sink substantially spanning a lateral width of the illumination aperture, and the lighting element being substantially vertically aligned with a center of the illumination aperture;

in the service position, the heat sink and lighting element being substantially laterally displaced away from the junction box relative to the operation position; and in the service position, the telescoping portion extending between the heat sink and the junction box and being operable to maintain a substantially contiguous enclosure between the junction box and the lighting element enclosure.

2. The low-profile light fixture of claim 1 comprising:

the junction box having a horizontal top wall, and having opposing vertical side walls extending laterally;

the telescoping portion having a vertical end wall, a horizontal top wall, and two opposing vertical side walls extending laterally;

the vertical end wall of the telescoping portion abutting a side of the base of the heat sink adjacent to the junction box, and spanning between the two opposing vertical side walls of the telescoping portion;

the horizontal top wall of the telescoping portion extending from the vertical end wall toward the junction box and abutting the top wall of the junction box; the two opposing vertical side walls of the telescoping portion extending from the horizontal top wall and the end wall of the telescoping portion toward the junction box and respectively abutting the opposing side walls of the junction box; and the telescoping portion maintaining a contiguous enclosure between the junction box and the lighting element enclosure when the light fixture is in the operation position, the service position, and all positions therebetween.

3. The low-profile light fixture of claim 2, wherein:

the horizontal top wall of the telescoping portion abuts an interior of the top wall of the junction box; and the two opposing vertical side walls of the telescoping portion respectively abut interior surfaces of the opposing side walls of the junction box.

4. The low-profile light fixture of claim 3 wherein:

when the light fixture is in the operation position, the horizontal top wall and the two opposing vertical side walls of the telescoping portion are disposed substantially entirely within the junction box and abut the interior surfaces of the respective top and opposing side walls of the junction box; and when the low-profile light fixture is in the service position, the horizontal top wall and the two opposing vertical side walls of the telescoping portion extend between the junction box and the lighting element enclosure to maintain a contiguous enclosure.

5. The low-profile light fixture of claim 2 wherein:

when the light fixture is in the operation position, the end wall of the telescoping portion is substantially vertically aligned with a side of the illumination aperture; and when the low-profile light fixture is in the service position, the end wall of the telescoping portion is substantially vertically aligned with a center line of the illumination aperture.

6. The low-profile light fixture of claim 1 wherein the heat sink moves no more than two (2) inches between the operation position and the service position.

7. The low-profile light fixture of claim 1 further comprising a lighting driver mount disposed within the junction box, the lighting driver mount comprising opposing guide rails, the lighting driver mount being affixed to the heat sink such that it translates along with the heat sink between the operation position and the service position;

the lighting driver comprising a mounting bracket comprising projections to engage with the opposing guide rails to suspend the lighting driver within the junction box.

8. The low-profile light fixture of claim 1 further comprising means for biasing the heat sink toward the operation position.

9. The low-profile light fixture of claim 1 further comprising a mechanism for locking the heat sink in the operation position.

10. The low-profile light fixture of claim 1 wherein the housing further comprises opposing end walls adapted to attach the low-profile light fixture to one or more support structures.

11. The low-profile light fixture if claim 1 wherein the lighting element enclosure further comprises one or more flanges extending inwardly from one or more side walls of the lighting element enclosure and abutting the lower surface of the base of the heat sink, the one or more flanges comprising a guide slot and one or more fasteners directed through the guide slot and into the base of the heat sink so as to guide the heat sink when moving between the operation position and the service position.

12. The low-profile light fixture of claim 11 wherein the one or more flanges of the lighting element enclosure further comprises a locking screw for locking the heat sink in the operation position, the service position, or any position in between.

13. The low-profile light fixture of claim 1 further comprising one or more brackets for mounting electrical connectors for controlling and delivering power to the lighting element, the one or more brackets being removably affixed to the heat sink such that the one or more brackets translationally move with the heat sink and, when the heat sink is in the service position, the one or more brackets are accessible and removable through the illumination aperture.

14. The low-profile light fixture of claim 13 wherein the one or more brackets are removably affixed to the heat sink using thumb nuts.

15. A low-profile light fixture comprising:

a housing having a base with an illumination aperture, a lighting element enclosure operable to move laterally horizontally and vertically relative to the base, and a junction box operable to move laterally horizontal relative to the base;

a lighting element disposed within the lighting element enclosure and a lighting driver disposed within the junction box;

a heat sink comprising a base and a plurality of fins extending upwardly therefrom, the base of the heat sink being affixed to the lighting element enclosure;

the light fixture having an operation position, an intermediate position, and a service position;

when the light fixture is in the operation position, the lighting element enclosure being substantially vertically aligned with the illumination aperture, the lighting element enclosure being positioned at a lowest vertical position relative to the housing, and the junction box being laterally displaced from the illumination aperture in a first direction;

when the light fixture is in the intermediate position, the lighting element enclosure being substantially vertically aligned with the illumination aperture and being positioned at a highest vertical position relative to the housing, the junction box being laterally displaced from the illumination aperture in the first direction, and the junction box being adapted to move laterally horizontally concurrently with the lighting element enclosure in a second direction opposite the first direction;

when the light fixture is in the service position, the lighting element enclosure being laterally horizontally displaced from the illumination aperture in the second direction, the junction box being substantially vertically aligned with the illumination aperture, an interior of the junction box being accessible through the illumination aperture, and the junction box being adapted to move laterally horizontally concurrently with the lighting element enclosure in the first direction.

16. The low-profile light fixture of claim 15, wherein:

the housing includes a pair of opposing guide rails operable to guide movement of the light element enclosure and junction box amongst the operation, intermediate and service positions;

each guide rail having a laterally-extending horizontal portion intersected by a pair of spaced-apart vertical portions depending downwardly from the horizontal portion, the vertical portions having upper and lower ends and the upper ends being aligned with the horizontal portion;

the junction box having a pair of guide pins on each of two opposing sides thereof, each pair adapted to engage and slide in the horizontal portion of one of the guide rails;

the lighting element enclosure having a pair of guide pins on each of two opposing sides thereof, each pair adapted to engage and slide in the horizontal and vertical portions of one of the guide rails;

when the light fixture is in the operation position, the guide pins of the lighting element enclosure are disposed at the lower ends of the vertical portions of an associated guide rail;

when the light fixture is in the intermediate position, the guide pins of the lighting element enclosure are disposed at the upper ends of the vertical portions of the associated guide rail; and when the light fixture is in the service position, the guide pins of the lighting element enclosure are disposed in the horizontal portion of the associated guide rail, and laterally displaced from the vertical portions thereof.

17. The low-profile light fixture of claim 16 wherein the lighting element enclosure further comprises a hook extending toward the junction box, the hook opening upwardly and engaging one of the pins of the junction box when the lighting element enclosure is in the intermediate position such that the junction box moves with the lighting element enclosure when the lighting element enclosure moves amongst the intermediate position and service position and such that the lighting element enclosure moves independently of the junction box when the lighting element enclosure moves amongst the intermediate position and operation position.

18. The low-profile light fixture of claim 17 wherein the lighting driver is mounted to a removable plate on a bottom of the junction box.

19. The low-profile light fixture of claim 15 further comprising means for biasing the lighting element enclosure toward the operation position.

* * * * *